US005547826A

United States Patent [19]

Ito et al.

[11] Patent Number: 5,547,826

[45] Date of Patent: Aug. 20, 1996

[54] SILVER HALIDE COLOR PHOTOGRAPHIC MATERIAL

[75] Inventors: Takayuki Ito; Yasuhiro Shimada; Koushin Matsuoka; Yasuhiro Yoshioka, all of Kanagawa, Japan

[73] Assignee: Fuji Photo Film Co., Ltd., Kanagawa, Japan

[21] Appl. No.: 532,525

[22] Filed: Sep. 22, 1995

[30] Foreign Application Priority Data

Oct. 12, 1994 [JP] Japan ..... 6-271874

[51] Int. Cl.[6] ..... G03C 7/38

[52] U.S. Cl. ..... 430/558; 430/387

[58] Field of Search ..... 430/558, 387

[56] References Cited

U.S. PATENT DOCUMENTS

| | | | |
|---|---|---|---|
| 4,910,127 | 3/1990 | Sakaki et al. | 430/558 |
| 5,256,526 | 10/1993 | Suzuki et al. | 430/384 |
| 5,270,153 | 12/1993 | Suzuki et al. | 430/384 |
| 5,348,847 | 9/1994 | Suzuki et al. | 430/558 |
| 5,366,856 | 11/1994 | Shimada et al. | 430/558 |
| 5,384,236 | 1/1995 | Matsuoka et al. | 430/558 |

FOREIGN PATENT DOCUMENTS

| | | | |
|---|---|---|---|
| 1177455 | 8/1986 | Japan | 430/558 |

*Primary Examiner*—Lee C. Wright
*Attorney, Agent, or Firm*—Sughrue, Mion, Zinn, Macpeak & Seas

[57] ABSTRACT

A silver halide photographic material comprising a support having provided thereon at least one layer containing a coupler represented by formula (I)

(I)

wherein Za represents —C($R_3$)= or —N=, provided that when Za represents —N=, Zb represents —C($R_3$)= and when Za represents —C($R_3$)=, Zb represents —N=; $R_1$ and $R_2$ each represents an electron withdrawing group having a Hammett's substituent constant, $\sigma_p$, of from 0.20 to 1.0; $R_3$ represents a substituent; $R_4$ and $R_5$ are the same or different, and each represents a hydrogen atom, an aliphatic group, an aryl group or a heterocyclic group; and $R_4$ and $R_5$ may combine with each other to form a 5-membered ring or a 6-membered ring and the 5-membered ring or the 6-membered ring may form a condensed ring with a benzene ring or a heterocyclic ring.

26 Claims, No Drawings

SILVER HALIDE COLOR PHOTOGRAPHIC MATERIAL

FIELD OF THE INVENTION

The present invention relates to a silver halide color photographic material containing a novel coupler.

BACKGROUND OF THE INVENTION

In a silver halide color photographic material, it is well known that an exposed silver halide is used as an oxidizing agent and an oxidized aromatic primary amine type color developing agent reacts with a coupler to produce indophenol, indoaniline, indamine, azomethine, phenoxazine, phenazine or a dye relating to these to form a dye image. In such a photographic system, a subtractive process is used and a dye image is formed by yellow, magenta and cyan dyes.

Among these, a phenol or naphthol type coupler is commonly used for forming a cyan dye image. However, these couplers have an undesirable absorption in the green region and accordingly, they are involved in a serious problem that the color reproducibility is conspicuously reduced, which is in need of solution.

As a means for solving this problem, U.S. Pat. Nos. 4,728,598 and 4,873,183 and EP 0249453A2 have proposed heterocyclic compounds. However, these couplers carry a fatal problem such that the coupling activity is low. As a coupler capable of overcoming this problem, pyrroloazoles have been proposed in EP 491197A1, EP 488248 and EP 545300. These couplers are excellent in view of hue and coupling activity. However, the dyes produced from the couplers described in the above-described patents are not always satisfactory in the light fastness and, in particular, the light fastness is inferior in the low color density part. Also, a problem remains that the color density varies due to the fluctuation in the composition of the processing solution and accordingly, an improvement in practical use has been demanded.

Further, among the pyrrolotriazole type couplers, those having a halogen atom as a releasing group are bounded to a problem of generation of heat stains which seem to be ascribable to the decomposition of the coupler itself.

SUMMARY OF THE INVENTION

An object of the present invention is to provide a silver halide color photographic material containing a coupler excellent in hue, coupling activity, heat fastness and light fastness (particularly, in the low color density part), less subject to fluctuation in color density induced by the change in the composition of the processing solution, and further having excellent heat stability of the coupler itself.

As a result of intensive investigations on the pyrrolotriazole type coupler, the present inventors have found that the object of the present invention can be achieved by the following means. Namely, the object has been achieved by a silver halide color photographic material comprising a support having thereon at least one layer containing at least one coupler represented by the following formula (I)

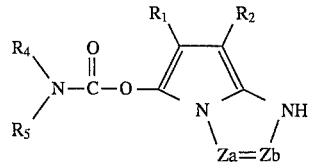

(I)

wherein Za represents —C($R_3$)= or —N=, provided that when Za represents —N=, Zb represents —C($R_3$)= and when Za represents —C($R_3$)=, Zb represents —N=; $R_1$ and $R_2$ each represents an electron withdrawing group having a Hammett's substituent constant, $\sigma_p$, of from 0.20 to 1.0; $R_3$ represents a substituent; $R_4$ and $R_5$ may be the same or different and each represents a hydrogen atom, an aliphatic group, an aryl group or a heterocyclic group; and $R_4$ and $R_5$ may combine with each other to form a 5-membered ring or a 6-membered ring and the 5-membered ring or the 6-membered ring may form a condensed ring with a benzene ring or a heterocyclic ring.

The compound of the present invention will be described below in detail.

The coupler of the present invention can be more specifically represented by the following formulae (II) and (III):

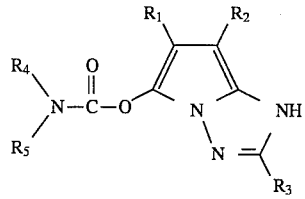

Formula (II)

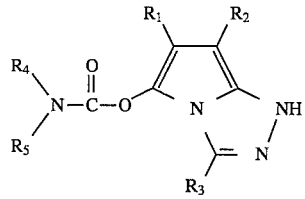

Formula (III)

wherein $R_1$, $R_2$, $R_3$, $R_4$ and $R_5$ each has the same meaning as in formula (I).

In the present invention, the coupler represented by formula (II) is particularly preferred.

In the coupler of the present invention, $R_1$ and $R_2$ each is an electron withdrawing group having $\sigma_p$ of from 0.20 to 1.0, but the sum of the $\sigma_p$ values of $R_1$ and $R_2$ is preferably 0.65 or more. The coupler of the present invention having introduced therein a strong electron withdrawing group as described above can show excellent properties as a cyan coupler. The sum of the $\sigma_p$ values of $R_1$ and $R_2$ is preferably 0.70 or more and the upper limit thereof is about 1.8.

In the present invention, $R_1$ and $R_2$ each is an electron withdrawing group having a Hammett's substituent constant $\sigma_p$ value (hereinafter, simply referred to as $\sigma_p$ value) of from 0.20 to 1.0, preferably from 0.30 to 0.8. The Hammett's rule is a rule of thumb advanced by L. P. Hammett in 1935 for quantitatively discussing the effect of the substituent on the reaction or equilibrium of benzene derivatives and is widely acknowledged at present justificative. The substituent constant determined by the Hammett's rule includes a $\sigma_p$ value and a $\sigma_m$ value and these values are described in many general publications, for example, in J. A. Dean, *Lange's Handbook of Chemistry,* Ver. 12, McGraw-Hill (1979), *Kagaku no Ryoiki Zo'kan,* No. 122, pp. 96–103, Nan'kodo (1979) and *Chemical Reviews,* Vol. 91, pp. 165–195 (1991). Although $R_1$ and $R_2$ of the present invention are prescribed by the Hammett's substituent constant $\sigma_p$ value, they are not limited to the substituents of which values are known in publications but of course include those of which values, when determined according to the Hammett's rule, fall in the prescribed range even though they are unknown in published literatures.

Specific examples of $R_1$ or $R_2$ as an electron withdrawing group having $\sigma_p$ value of from 0.20 to 1.0 include an acyl group, an acyloxy group, a carbamoyl group, an aliphatic oxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, an alkyl group substituted by at least two or more halogen atoms, an alkoxy group substituted by at least two or more halogen atoms, an aryloxy group substituted by at least two or more halogen atoms, an alkylamino group substituted by at least two or more halogen atoms, an alkylthio group substituted by at least two or more halogen atoms, an aryl group substituted by other electron withdrawing group having $\sigma_p$ of 0.20 or more, a heterocyclic group, a chlorine atom, a bromine atom, an azo group and a selenocyanate group. Among these substituents, the groups which can have a substituent may further have a substituent such as those described below for $R_3$.

The aliphatic oxycarbonyl group has an aliphatic moiety which may be linear, branched or cyclic, or saturated or unsaturated, and the aliphatic oxycarbonyl group includes alkoxycarbonyl, cycloalkoxycarbonyl, alkenyloxycarbonyl, alkynyloxycarbonyl and cycloalkenyloxycarbonyl.

Representative examples of the electron withdrawing group having a $\sigma_p$ value of from 0.2 to 1.0 and the $\sigma_p$ value of those are described below: a bromine atom (0.23), a chlorine atom (0.23), a cyano group (0.66), a nitro group (0.78), a trifluoromethyl group (0.54), a tribromomethyl group (0.29), a trichloromethyl group (0.33), a carboxyl group (0.45), an acetyl group (0.50), a benzoyl group (0.43), an acetyloxy group (0.31), a trifluoromethanesulfonyl group (0.92), a methanesulfonyl group (0.72), a benzenesulfonyl group (0.70), a methanesulfinyl group (0.49), a carbamoyl group (0.36), a methoxycarbonyl group (0.45), an ethoxycarbonyl group (0.45), a phenoxycarbonyl group (0.44), a pyrazolyl group (0.37), a methanesufonyloxy group (0.36), a dimethoxyphosphoryl group (0.60) and a sulfamoyl group (0.57).

$R_1$ is preferably a cyano group, an aliphatic oxycarbonyl group (including an aliphatic oxycarbonyl group having 2–36 carbon atoms such as a linear or branched alkoxycarbonyl group, an aralkyloxycarbonyl group, an alkenyloxycarbonyl group, an alkynyloxycarbonyl group, a cycloalkoxycarbonyl group or a cycloalkenyloxycarbonyl group; e.g., methoxycarbonyl, ethoxycarbonyl, dodecyloxycarbonyl, octadecyloxycarbonyl, 2-ethylhexyloxycarbonyl, secbutyloxycarbonyl, oleyloxycarbonyl, benzyloxycarbonyl, propargyloxycarbonyl, cyclopentyloxycarbonyl, cyclohexyloxycarbonyl, 2,6-di-t-butyl-4-methylcyclohexyloxycarbonyl), a dialkylphosphono group (including a dialkylphosphono group having from 2 to 36 carbon atoms, e.g., diethylphosphono, dimethylphosphono), an alkyl- or arylsulfonyl group (including an alkyl- or arylsulfonyl group having from 1 to 36 carbon atoms, e.g., methanesulfonyl, butanesulfonyl, benzenesulfonyl, p-toluenesulfonyl) or a fluorinated alkyl group (including a fluorinated alkyl group having from 1 to 36 carbon atoms, e.g., trifluoromethyl). $R_1$ is particularly preferably a cyano group, an aliphatic oxycarbonyl group or a fluorinated alkyl group, and most preferably a cyano group.

$R_2$ is preferably an aliphatic oxycarbonyl group as described for $R_1$, a carbamoyl group (including a carbamoyl group having from 1 to 36 carbon atoms, e.g., diethylcarbamoyl, dioctylcarbamoyl), a sulfamoyl group (including a sulfamoyl group having from 1 to 36 carbon atoms, e.g., dimethylsulfamoyl, dibutylsulfamoyl), a dialkylphosphono group as described for $R_1$ or a diarylphosphono group (including a diacrylphosphono group having from 12 to 50 carbon atoms, e.g., diphenylphosphono, di(p-toluyl)phosphono). $R_2$ is particularly preferably an aliphatic oxycarbonyl group represented by the following formula:

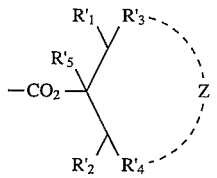

(IV)

In the formula, $R_1'$ and $R_2'$ each represents an aliphatic group preferably having 1 to 36 carbon atoms and examples thereof include a linear or branched alkyl group, an aralkyl group, an alkenyl group, an alkynyl group, a cycloalkyl group or a cycloalkenyl group, such as methyl, ethyl, propyl, isopropyl, t-butyl, t-amyl, t-octyl, tridecyl, cyclopentyl or cyclohexyl. $R_3'$, $R_4'$ and $R_5'$ each represents a hydrogen atom or an aliphatic group. The aliphatic group includes the groups described above for $R_1'$ and $R_2'$. $R_3'$, $R_4'$ and $R_5'$ each is more preferably a hydrogen atom.

Z is a nonmetallic atomic group necessary for forming a 5-, 6-, 7- or 8-membered ring and the ring may be substituted, may be a saturated ring or may have an unsaturated bond. The nonmetallic atom is preferably a nitrogen atom, an oxygen atom, a sulfur atom or a carbon atom, more preferably a carbon atom.

Examples of the ring formed by Z include a cyclopentane ring, a cyclohexane ring, a cycloheptane ring, a cyclooctane ring, a cyclohexene ring, a piperazine ring, an oxane ring and a thiane ring. These rings may be substituted by a substituent described below for $R_3$.

The ring formed by Z is preferably a cyclohexane ring which may be substituted, more preferably a cyclohexane ring substituted at the 4-position by an alkyl group (which may be substituted by a substituent described below for $R_3$) having from 1 to 24 carbon atoms.

$R_3$ represents a substituent and examples thereof include a halogen atom (e.g., fluorine, chlorine, bromine), an aliphatic group (including an aliphatic group having from 1 to 36 carbon atoms, e.g., a linear or branched alkyl group, an aralkyl group, an alkenyl group, an alkynyl group, a cycloalkyl group or a cycloalkenyl group, more specifically, such as methyl, ethyl, propyl, isopropyl, t-butyl, tridecyl, t-amyl, t-octyl, 2-methanesulfonylethyl, 3-(3-pentadecylphenoxy)propyl, 3-{4-{2-[4-(4-hydroxyphenylsulfonyl)phenoxy]dodecaneamido}phenyl}propyl, 2-ethoxytridecyl, trifluoromethyl, cyclopentyl, 3-(2,4-di-tamylphenoxy)propyl), an aryl group (including an aryl group having from 6 to 36 carbon atoms, e.g., phenyl, 4-t-butylphenyl, 2,4-di-t-amylphenyl, 4-tetradecaneamidophenyl, 2-methoxyphenyl), a heterocyclic group (including a heterocyclic group having from 1 to 36 carbon atoms, e.g., 2-furyl, 2-thienyl, 2-pyrimidinyl, 2-benzothiazolyl), a cyano group, a hydroxyl group, a nitro group, a carboxy group, an amino group, an alkoxy group (including a linear, branched or cyclic alkoxy group having from 1 to 36 carbon atoms, e.g., methoxy, ethoxy, butoxy, 2-methoxyethoxy, 2-dodecyloxyethoxy, 2-methanesulfonylethoxy), an aryloxy group (including an aryloxy group having from 6 to 36 carbon atoms, e.g., phenoxy, 2-methylphenoxy, 4-t-butylphenoxy, 3-nitrophenoxy, 3-t-butyloxycarbamoylphenoxy, 3-methoxycarbamoyl), an acylamino group (including an acylamino group having from 2 to 36 carbon atoms, e.g., acetamido, benzamido, tetradecaneamido, 2-(2,4-di-t-amylphenoxy)butaneamido, 4-(3-t-butyl-4-hydroxyphenoxy)butaneamido, 2-{4-(4-hydroxyphenylsulfonyl)phenoxy}decaneamido), an alkylamino group (including an alkylamino group having from 1 to 36 carbon atoms, e.g., methylamino, butylamino, dodecylamino, diethylamino, methylbutylamino), an anilino group (including an anilino group having from 6 to 36 carbon atoms, e.g., phenylamino, 2-chloroanilino, 2-chloro-5 -tetradecaneaminoanilino, 2-chloro-5-dodecyloxycarbonylanilino, N-acetylanilino, 2-chloro-5-{2-(3-t-butyl-4-hydroxyphenoxy)dodecaneamido}anilino), a ureido group (including a ureido group having from 2 to 36 carbon atoms, e.g., phenylureido, methylureido, N,N-dibutylureido), a sulfamoylamino group (including a sulfamoylamino group having from 1 to 36 carbon atoms, e.g., N,N-dipropylsulfamoylamino, N-methyl-N-decylsulfamoylamino), an alkylthio group (including an alkylthio group having from 1 to 36 carbon atoms, e.g., methylthio, octylthio, tetradecylthio, 2-phenoxyethylthio, 3-phenoxypropylthio, 3-(4-t-butylphenoxy)propylthio), an arylthio group (including an arylthio group having from 6 to 36 carbon atoms, e.g., phenylthio, 2-butoxy-5-t-octylphenylthio, 3-pentadecylphenylthio, 2-carboxyphenylthio, 4-tetradecaneamidophenylthio), an alkoxycarbonylamino group (including an alkoxycarbonylamino group having from 2 to 36 carbon atoms, e.g., methoxycarbonylamino, tetradecyloxycarbonylamino), a sulfonamido group (including an alkyl- or arylsulfonamido group having from 1 to 36 carbon atoms, e.g., methanesulfonamido, butanesulfonamido, octanesulfonamido, hexadecanesulfonamido, benzenesulfonamido, p-toluenesulfonamido, octadecanesulfonamido, 2-methoxy-5-t-butylbenzenesulfonamido), a carbamoyl group (including a carbamoyl group having from 1 to 36 carbon atoms, e.g., N-ethylcarbamoyl, N,N-dibutylcarbamoyl, N-(2 -dodecyloxyethyl)carbamoyl, N-methyl-N-dodecylcarbamoyl, N-{3-(2,4-di-t-amylphenoxy)propyl}carbamoyl), a sulfamoyl group (including a sulfamoyl group having from 1 to 36 carbon atoms, e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (including an alkyl- or arylsulfonyl group having from 1 to 36 carbon atoms, e.g., methanesulfonyl, octanesulfonyl, benzenesulfonyl, toluenesulfonyl), an alkoxycarbonyl group (including an alkoxycarbonyl group having from 2 to 36 carbon atoms, e.g., methoxycarbonyl, butyloxycarbonyl, dodecyloxycarbonyl, octadecyloxycarbonyl), a heterocyclic oxy group (including a heterocyclic oxy-group having from 1 to 36 carbon atoms, e.g., 1-phenyltetrazole-5-oxy, 2-tetrahydropyranyloxy), an azo group (including an azo group having from 1 to 36 carbon atoms, e.g., phenylazo, 4-methoxyphenylazo, 4-pivaloylaminophenylazo, 2-hydroxy-4-propanoylphenylazo), an acyloxy group (including an acyloxy group having from 2 to 36 carbon atoms, e.g., acetoxy), a carbamoyloxy group (including a carbamoyloxy group having from 1 to 36 carbon atoms, e.g., N-methylcarbamoyloxy, N-phenylcarbamoyloxy), a silyloxy group (including a silyloxy group having from 3 to 36 carbon atoms, e.g., trimethylsilyloxy, dibutylmethylsilyloxy), an aryloxycarbonylamino group (including an aryloxycarbonylamino group having from 7 to 36 carbon atoms, e.g., phenoxycarbonylamino), an imido group (including an imido group having from 4 to 36 carbon atoms, e.g., N-succinimido, N-phthalimido, 3-octadecenylsuccinimido), a heterocyclic thio group (including a heterocyclic thio group having from 1 to 36 carbon atoms, e.g., 2-benzothiazolylthio, 2,4-diphenoxy-1,3,5-triazole-6-thio, 2-pyridylthio), a sulfinyl group (including a sulfinyl group having from 1 to 36 carbon atoms, e.g., dodecanesulfinyl, 3-pentadecylphenylsulfinyl), a phosphonyl group (including a phosphonyl group having from 1 to 36 carbon atoms, e.g., phenoxyphosphonyl, octyloxyphosphonyl, phenylphosphonyl), an aryloxycarbonyl group (including an aryloxycarbonyl group having from 7 to 36 carbon atoms, e.g., phenoxycarbonyl), an acyl group (including an acyl group having from 2 to 36 carbon atoms, e.g., acetyl, 3-phenylpropanoyl, benzoyl, 4-dodecyloxybenzoyl) and an azolyl group (e.g., imidazolyl, pyrazolyl, 3-chloro-pyrazol-1-yl, triazolyl). Among these substituents, those which can be substituted may further be substituted by a substituent described above.

$R_3$ is preferably an aliphatic group or an aryl group, more preferably a branched alkyl group or a cycloalkyl group.

$R_4$ and $R_5$ each represents a hydrogen atom, an aliphatic group, an aryl group or a heterocyclic group. More specifically, the aliphatic group is preferably an aliphatic group from 1 to 36 carbon atoms, such as a linear or branched alkyl group, an aralkyl group, an alkenyl group, an alkynyl group, a cycloalkyl group or a cycloalkenyl group, which may be substituted by a substituent described above for $R_3$. Examples of the aliphatic group include methyl, ethyl, propyl, isopropyl, t-butyl, tridecyl, t-amyl, t-octyl, 2-methanesulfonylethyl, 3-(3-pentadecylphenoxy)propyl, 3-{4-{2 -[4-(4-hydroxyphenylsulfonyl)phenoxy] dodecaneamido}phenyl}-propyl, 2-ethoxytridecyl, trifluoromethyl, cyclopentyl, cyclohexyl and 3-(2,4-di-t-amylphenoxypropyl).

The aryl group for $R_4$ and $R_5$, which may be either monocyclic or polycyclic, is preferably an aryl group having from 6 to 36 carbon atoms and may be substituted by a substituent described above for $R_3$. Examples of the aryl group include phenyl, naphthyl, 4-t-butylphenyl, 2,4-di-tamylphenyl, 4-tetradecaneamidophenyl and 2-methoxyphenyl.

The heterocyclic group for $R_4$ and $R_5$ is preferably a 5-, 6-, 7- or 8-membered ring containing as a hetero atom a nitrogen atom, an oxygen atom or a sulfur atom and having preferably from 1 to 36 carbon atoms, and the heterocyclic ring includes a condensed ring with other heterocyclic ring or benzene ring and may be substituted by a substituent described above for $R_3$. Examples of the heterocyclic group include 2-furyl, 2-thienyl, imidazolyl, thiazolyl, 2-pyrimidinyl and 2-benzothiazolyl.

$R_4$ and $R_5$ may be the same or different. $R_4$ and $R_5$ may also be combined with each other to form a 5-membered ring or a 6-membered ring and the 5-membered ring or the 6-membered ring may form a condensed ring with a benzene ring or a heterocyclic ring.

When $R_4$ and $R_5$ are combined with each other to form a 5-membered ring or a 6-membered ring together with the nitrogen atom, the cyclic compound is a cyclic amine such as a cyclic amido compound, a cyclic imido compound, a cyclic urea compound, an imidazole, a pyrazole, a triazole, a lactam compound, a piperidine, a pyrrolidine, a pyrrole, a morpholine, a pyrazolidine and a pyrazoline.

In a particularly preferred embodiment of the present invention, the compound represented by formula (I) is represented by the following formula (V):

(V)

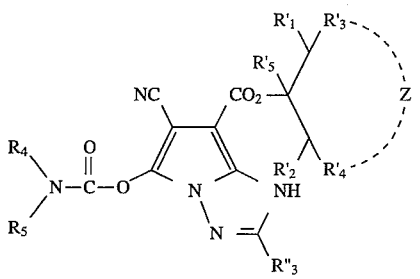

In formula (V), $R_4$, $R_5$, $R_1'$ to $R_5'$ and Z each has the same meaning as defined above and $R_3''$ represents an aliphatic group or an aryl group.

More preferably, $R_3''$ represents a branched alkyl group or a cycloalkyl group, $R_3'$, $R_4'$ and $R_5'$ each represents a hydrogen atom and the ring formed by Z represents a cyclohexane ring.

In the coupler represented by formula (I), the group represented by $R_2$ or $R_3$ may contain a coupler residue represented by formula (I) to form a dimer or greater polymer, or the group represented by $R_2$ or $R_3$ may contain a polymer chain to form a homopolymer or a copolymer. A typical example of the homopolymer or copolymer containing a polymer chain is a homo- or copolymer of an addition polymer ethylenically unsaturated compound having a coupler residue represented by formula (I). In this case, the polymer may contain one or more cyan-color forming repeating units having a coupler residue represented by formula (I) or may be a copolymer containing as a copolymer component one or more non-color forming ethylenic monomers incapable of coupling with an oxidation product of an aromatic primary amine developing agent such as acrylic ester, methacrylic ester or maleic ester.

Specific examples of the coupler of the present invention are set forth below, but the present invention is by no means limited to these.

(1)

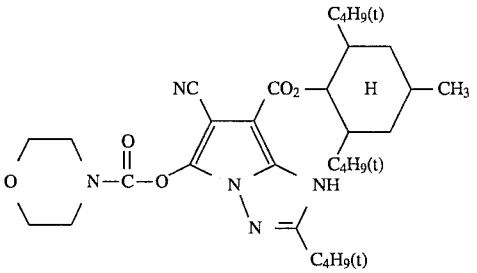

(2)

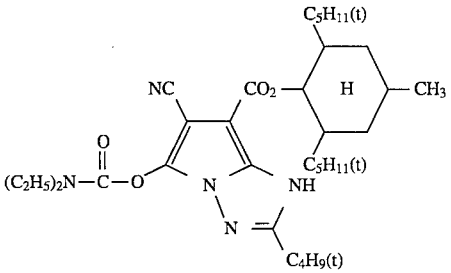

(3)

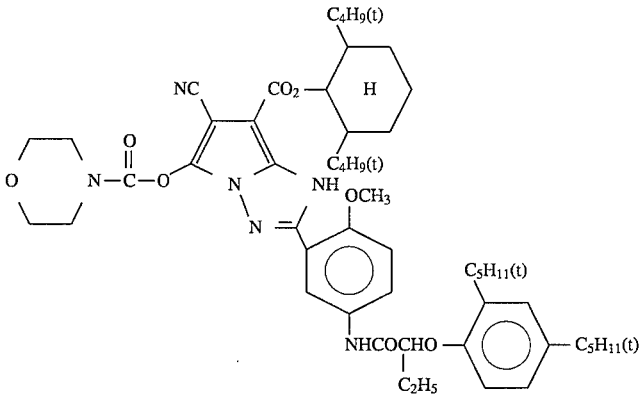

(4)

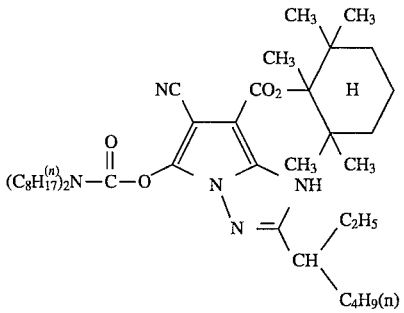

-continued
(5)
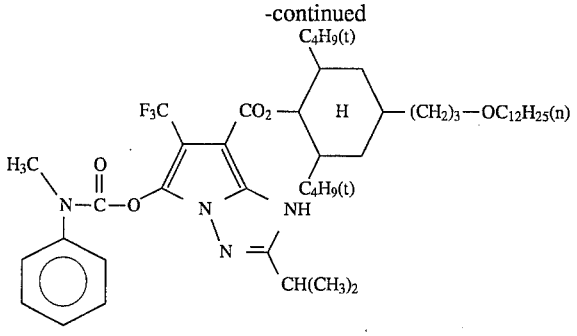
(6)
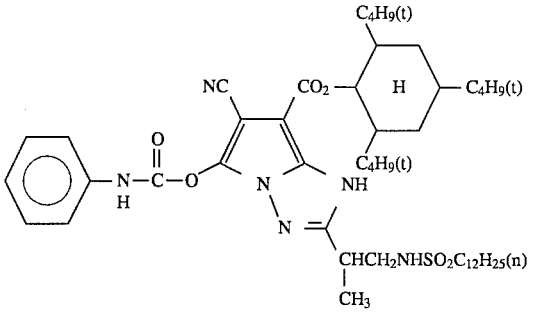
(7)
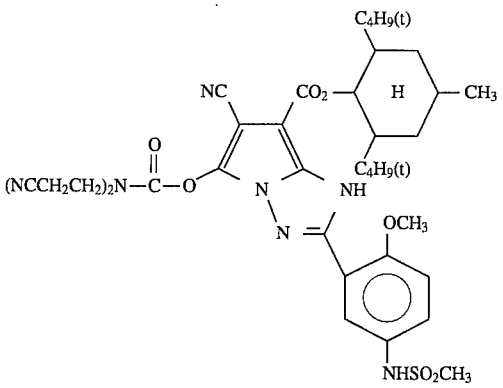
(8)
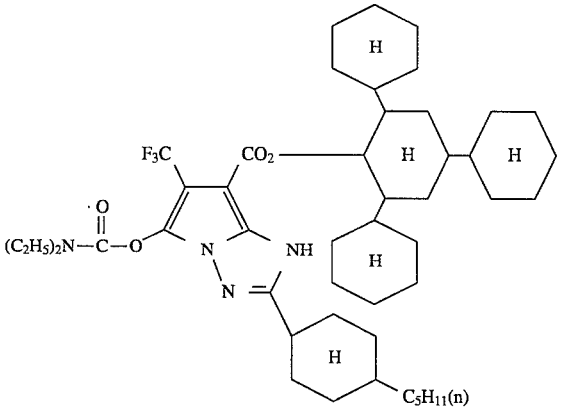
(9)
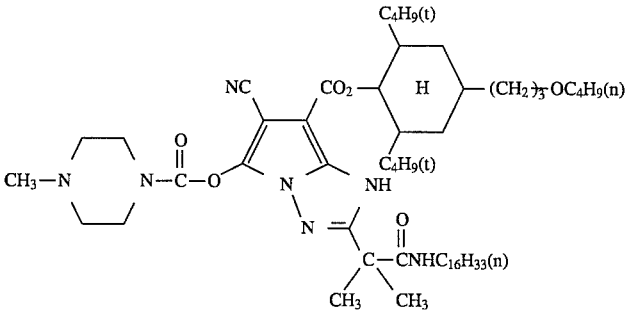

-continued
(10)
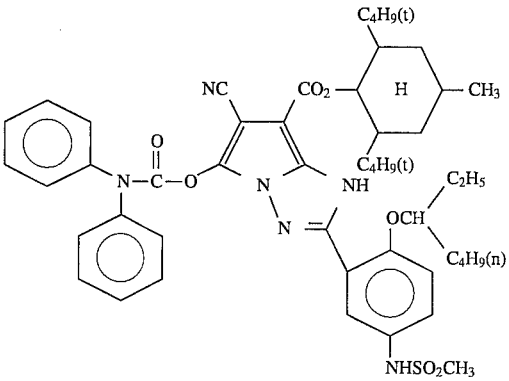
(11)
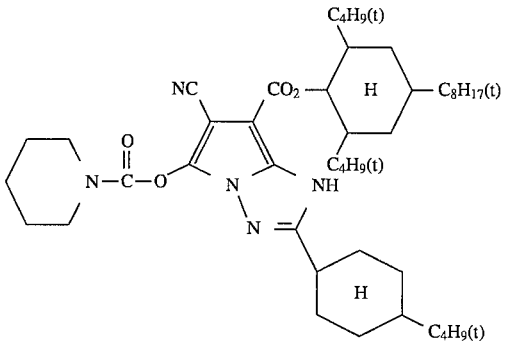
(12)
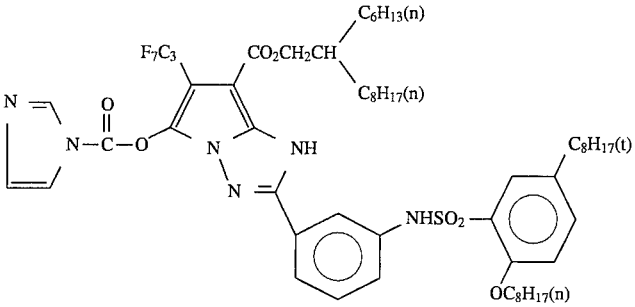
(13)
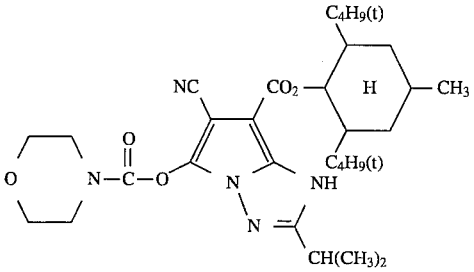
(14)
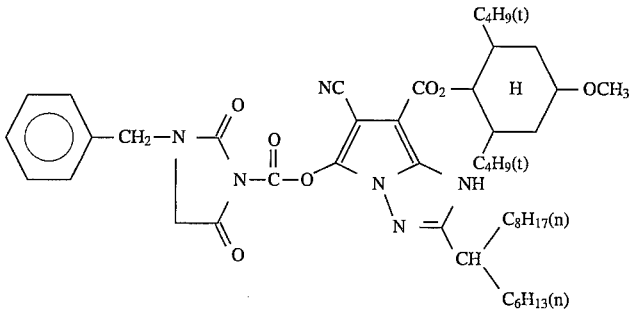
(15)
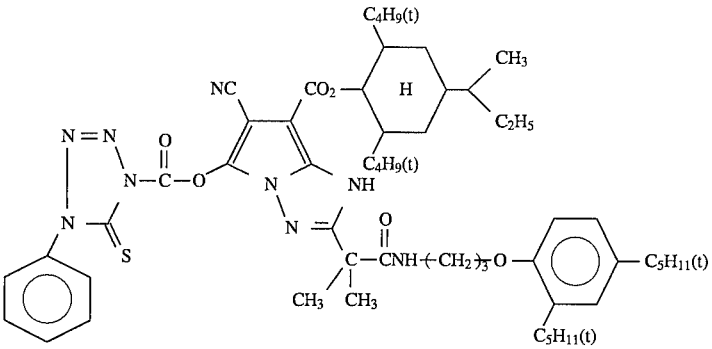

-continued
(16)
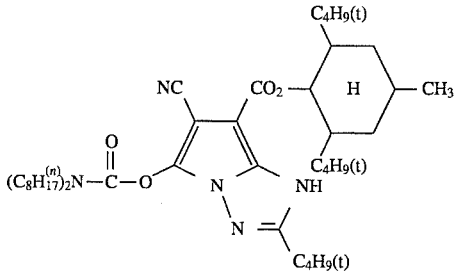
(17)
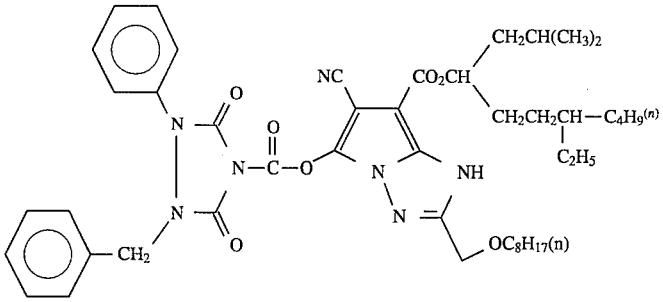
(18)
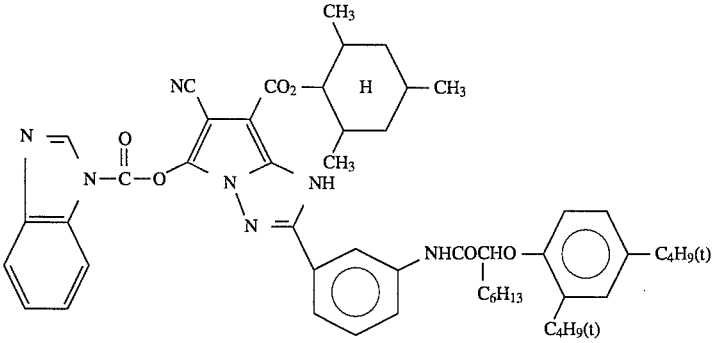
(19)
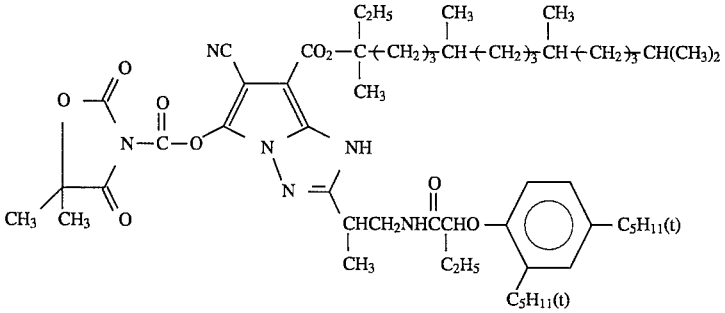
(20)
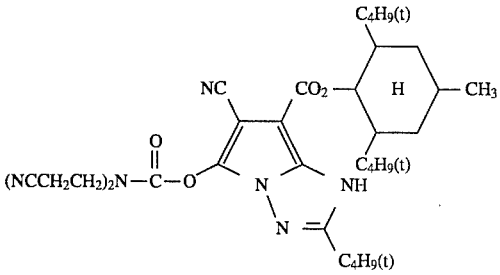
(21)
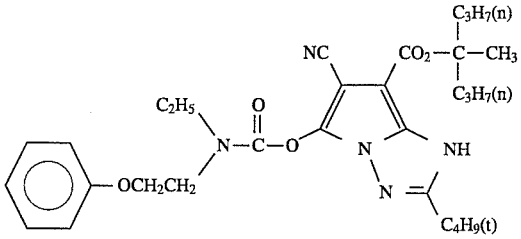

-continued
(22)
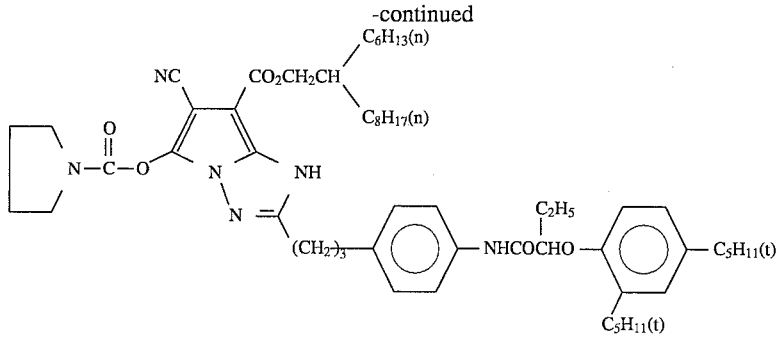
(23)
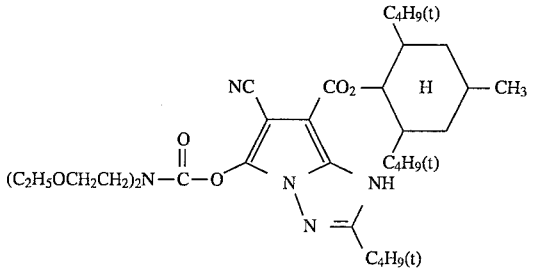
(24)
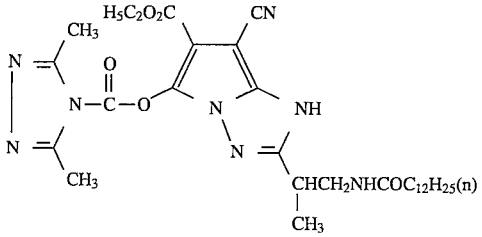
(25)
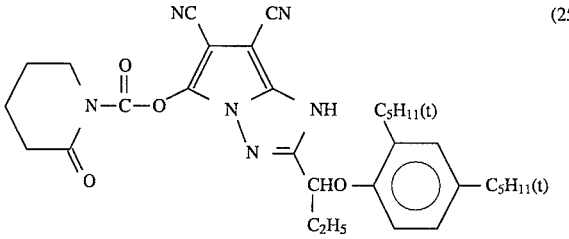
(26)
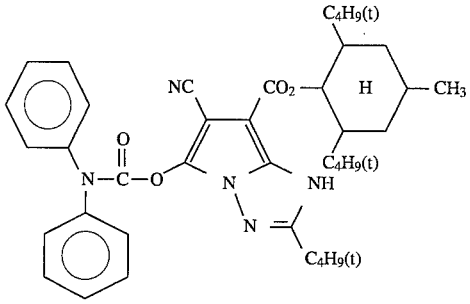
(27)
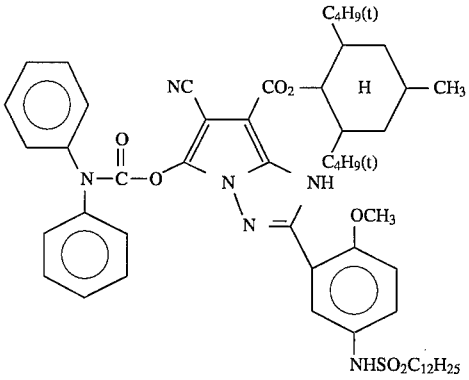
(28)
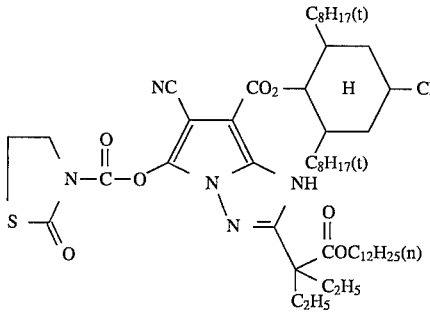
(29)
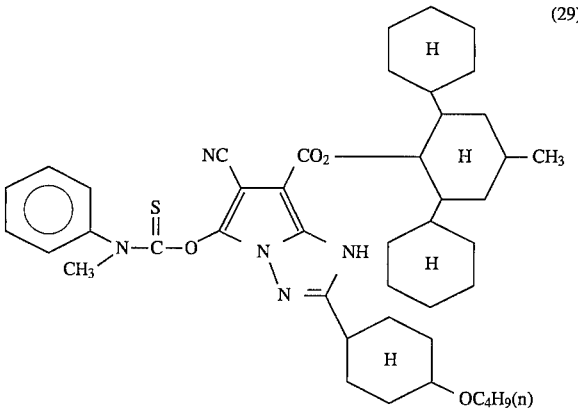
(30)
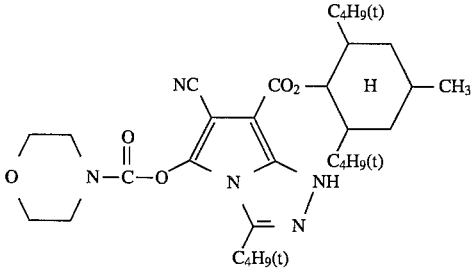

-continued
(31)
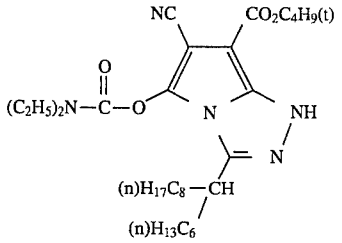
(32)
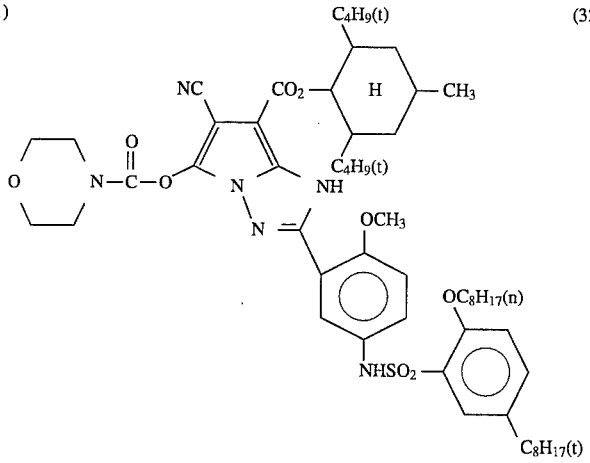
(33)
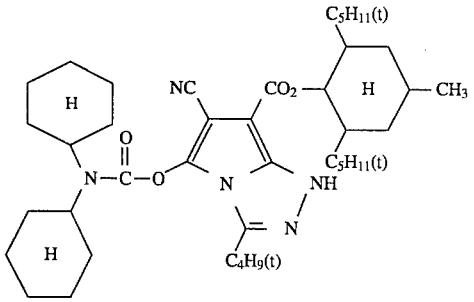
(34)
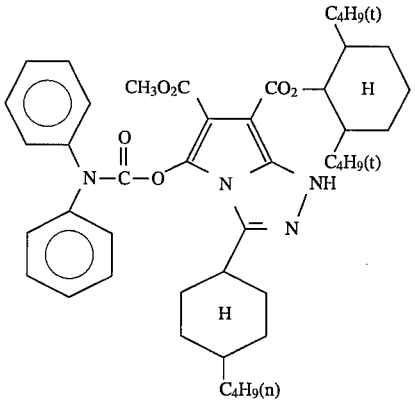
(35)
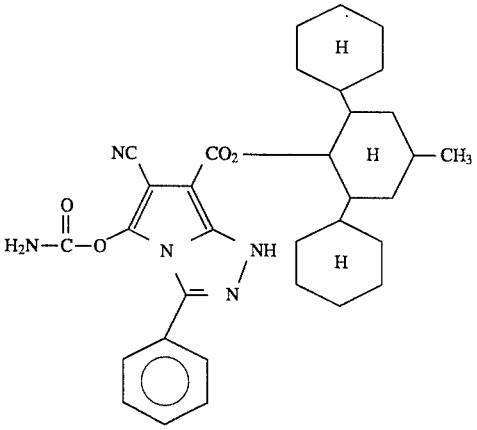
(36)
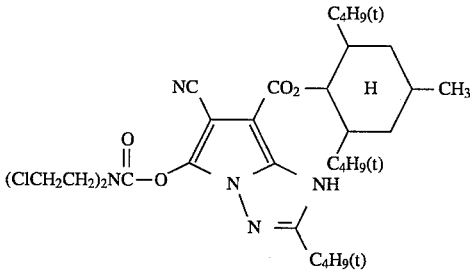
(37)
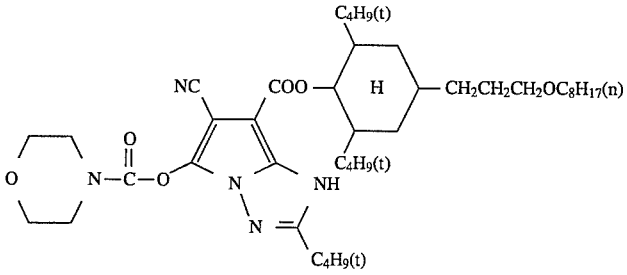

-continued
(38)
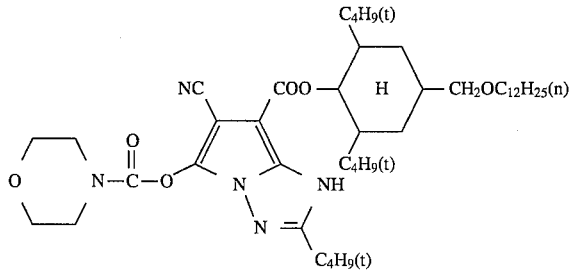
(39)
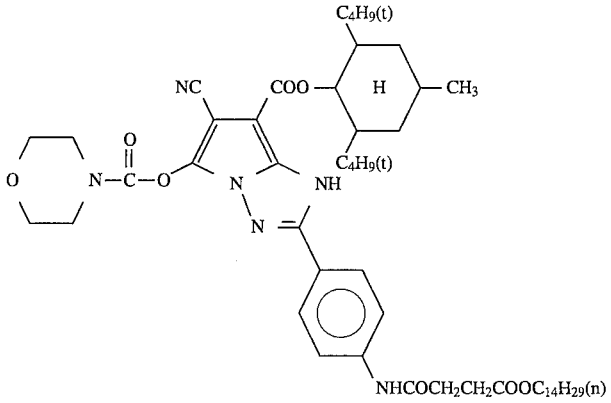
(40)
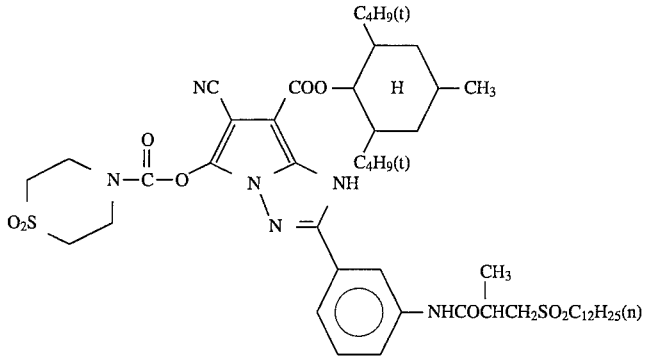
(41)
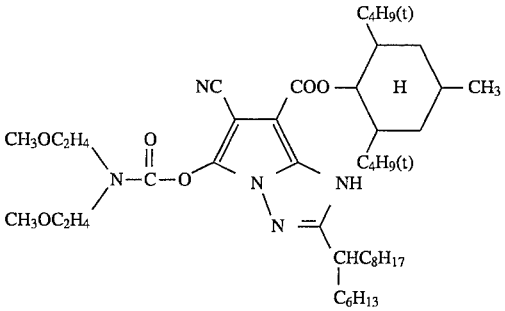
(42)
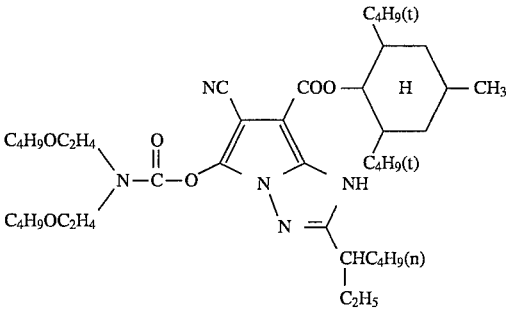
(43)
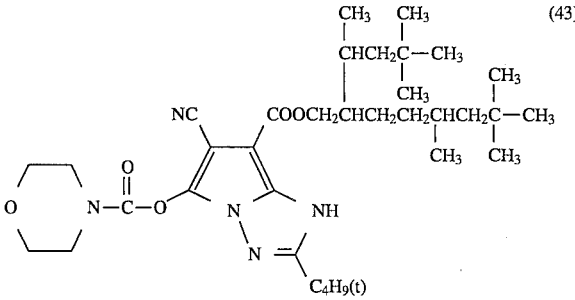
(44)
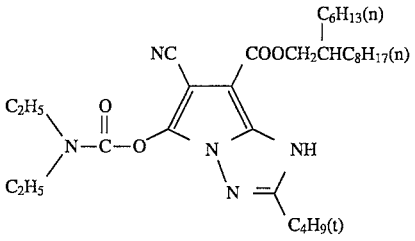

-continued

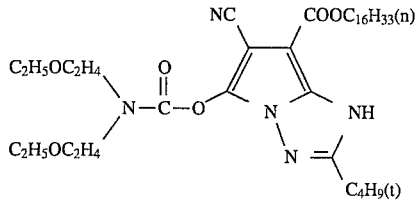

(45)

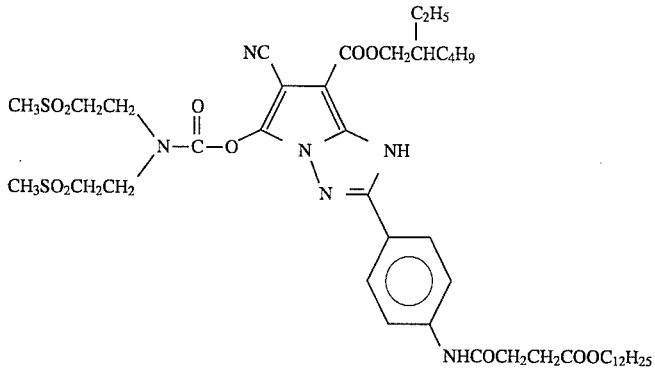

(46)

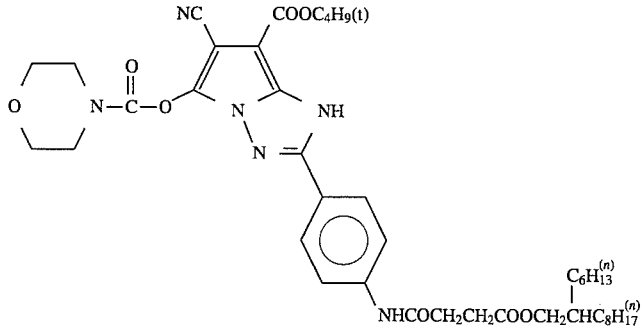

(47)

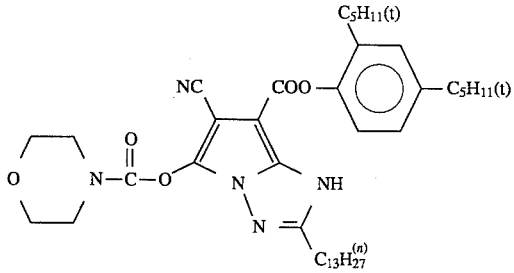

(48)

The compound represented by formula (I) of the present invention can be easily synthesized according, for example, to the following synthesis example using as a starting material a triazole compound represented by the following formula (VI) which can be synthesized according to a known method, for example, the methods described in *J. C. S.*, p. 518 (1961), *J. C. S.*, p. 5149 (1962), *Angew. Chem.*, Vol. 72, p. 956 (1960), *Berichte*, Vol. 97, p. 3436 (1964) and literatures cited in these publications or the methods analogous thereto.

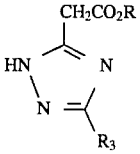

(VI)

wherein R is a hydrogen atom or an alkyl group and $R_3$ represents a substituent.

Specific synthesis examples of the compound of the present invention are described below.

Synthesis Example 1: Synthesis of Compound (1)

Compound (1) was synthesized through the following route.

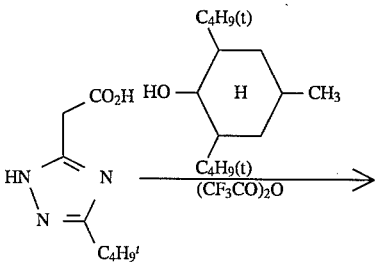

(a)

-continued

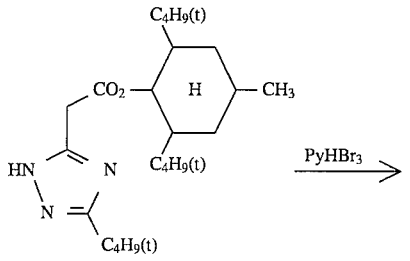

(b)

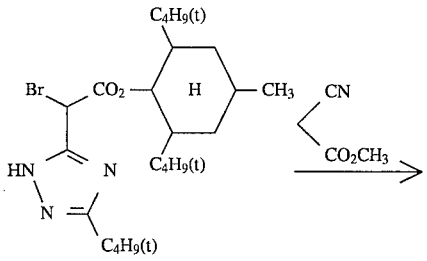

(c)

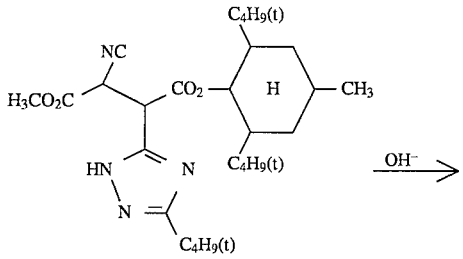

(d)

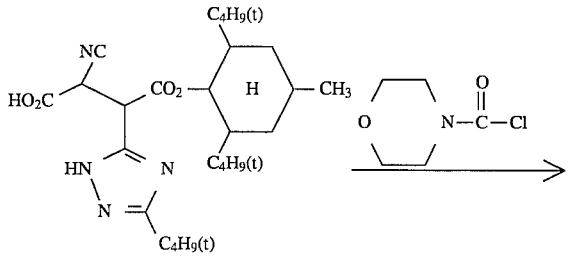

(e)

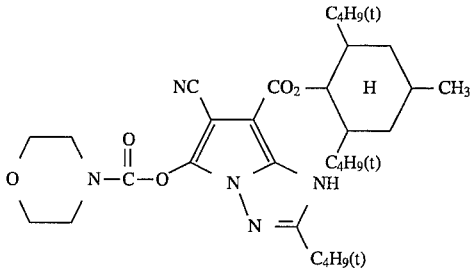

Synthesis of Compound b

To an acetonitrile 200 ml solution of 2,6-di-t-butyl- 4-methylcyclohexanol (17 g, 75 mmol), trifluoroacetic anhydride (10.6 ml, 75 mmol) was added dropwise at 0° C. and subsequently, Compound a (11 g, 60.4 mmol) was gradually added. The reaction solution was stirred at room temperature for 2 hours and after adding 300 ml of water thereto, it was extracted with 300 ml of ethyl acetate. The organic phase was washed with a sodium dicarbonate solution, water and brine. After drying the product over sodium sulfate, the solvent was distilled off under reduced pressure to obtain Crude Compound b (14 g). The Crude Compound b (14 g) was used in the next step without being refined.

Synthesis of Compound c

To a tetrahydrofran 200 ml solution of Crude Compound b (14 g), pyridinium bromide perbromide (12.7 g, 40 mmol) was added at room temperature and stirred for 8 hours. After adding thereto 200 ml of a 2 g aqueous solution of sodium sulfite, the reaction solution was extracted with 300 ml of ethyl acetate. The organic phase was washed with water and brine and then dried over sodium sulfate. The solvent was distilled off under reduced pressure to obtain Crude Compound c (15 g). The Crude Compound c (15 g) was used in the next step without being purified.

Synthesis of Compound d

To a tetrahydrofran 50 ml solution of methyl cyanoacetate (9.5 g, 96 mmol), sodium hydride (3.2 g, 80 mmol) was gradually added at 0° C. and stirred at room temperature for 30 minutes (Solution s). To a tetrahydrofran 100 ml solution of Crude Compound c (15 g), Solution s was added dropwise at 0° C. and stirred at room temperature for 1 hour. The reaction solution was extracted by adding 200 ml of 1N hydrochloric acid and 200 ml of ethyl acetate. The organic phase was washed with water and brine and dried over sodium sulfate and then, the solvent was distilled off under reduced pressure. The resulting residue was purified by a column chromatography to obtain Compound d (12.1 g).

Synthesis of Compound e

To a methanol 100 ml solution of Compound d (12.1 g, 24.8 mmol), 50 ml of a 5 g aqueous solution of sodium hydroxide was added and stirred at 50° C. for 2 hours. The reaction solution was extracted by adding 200 ml of 1N hydrochloric acid and 200 ml of ethyl acetate. The organic phase was washed with water and brine and dried over sodium sulfate and then, the solvent was distilled off under reduced pressure to obtain Compound e (11.2 g).

Synthesis of Compound (1)

To a pyridine (60 ml) solution of Compound (e) (11.2 g, 23.6 mmol), morpholinocarbamoyl chloride (6.7 g, 44.8 mmol) was added dropwise at 0° C. The resulting solution was stirred at room temperature for 2 hours, poured into 200 ml of diluted hydrochloric acid solution and then extracted with 100 ml of ethyl acetate. The organic phase was washed with water (three times) and then dried over sodium sulfate. The product was concentrated under reduced pressure and recrystallized from ethyl acetate-hexane to obtain objective Compound (1) (10.3 g, 18.1 mmol, melting point: 268°–272° C.).

Synthesis Example 2: Synthesis of Compound (7)

Compound (7) was synthesized according to the following scheme (the synthesis until Compound (f) was conducted in the same manner as in Synthesis Example 1).

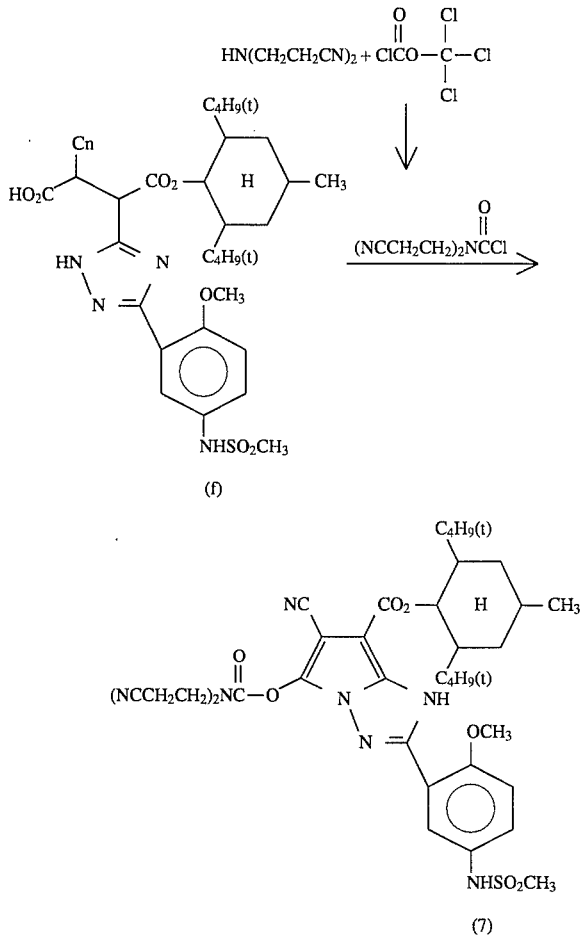

To a dichloromethane (10 ml) solution of chlorotrichloromethyl formate (1.23 ml, 10.2 mmol), a dichloromethane (10 ml) solution of bis(cyanoethyl)amine (2.23 g, 20.4 mmol) and diisopropylethylamine (2.64 g, 20.4 mmol) was added dropwise at 0° C. and then stirred at room temperature for 30 minutes.

The resulting solution was added dropwise to a pyridine (100 ml) solution of Compound (f) (5.75 g, 9.30 mmol) at 0° C. The mixed solution was stirred at room temperature for 2 hours, then poured into 500 ml of diluted hydrochloric acid solution and extracted with 200 ml of ethyl acetate. The organic phase was washed with water (three times) and then dried over sodium sulfate. The product was concentrated under reduced pressure and purified by a column chromatography to obtain objective Compound (7) (4.2 g, 5.6 mmol, melting point: 217°–218° C.).

Synthesis Example 3: Synthesis of Compound (16)

The synthesis of Compound (7) was thoroughly repeated except for using dioctylcarbamoyl chloride (4.93 g, 20.4 mmol) and Compound (e) (4.41 g, 9.30 mmol) in place of 2.23 g of bis(cyanoethyl)amine and 5.75 g of Compound (f), respectively, and then objective Compound (16) (2.96 g, 4.09 mmol, melting point: 170°–171° C.) was obtained.

Other compounds can be synthesized in the same manner.

The photographic material of the present invention may suffice if it has at least one layer containing the coupler of the present invention on the support and the layer containing the coupler of the present invention may be any if it is a hydrophilic colloid layer provided on the support. The photographic material may be in general constituted as such at least one blue-sensitive silver halide emulsion layer, at least one green-sensitive silver halide emulsion layer and at least one red-sensitive silver halide emulsion layer are provided in this order on a support, however, the order of layers may be different order. Also, an infrared-sensitive silver halide emulsion layer may be used in place of at least one of the above-described light-sensitive emulsion layers. These light-sensitive emulsion layers contain a silver halide emulsion having sensitivity to respective wavelength regions and a coupler for forming a dye being in a complementary color relation with the light to which the layer is sensitive so that the color reproduction can be conducted by subtractive process. However, the light-sensitive emulsion layer and the colored hue of the color coupler may be rid of the above-described correspondence.

The coupler of the present invention is particularly preferably used in the red-sensitive silver halide emulsion layer as a cyan coupler.

The coupler of the present invention is contained in the photographic material in an amount of suitably from $1\times10^{-3}$ to 1 mol, preferably from $2\times10^{-3}$ to $3\times10^{-1}$ mol, per mol of silver halide in the same layer.

The coupler of the present invention can be introduced into the photographic material by various known dispersion methods, preferably by an oil-in-water dispersion method where the coupler is dissolved in a high boiling point organic solvent (if desired, in combination with a low boiling point organic solvent), emulsion-dispersed in an aqueous gelatin solution and then added to a silver halide emulsion.

Examples of the high boiling point solvent for use in the oil-in-water dispersion method are described in U.S. Pat. No. 2,322,027. Further, the processing and effect of the latex dispersion method as one of the polymer dispersion methods and specific examples of the latex for impregnation are described in U.S. Pat. No. 4,199,363, West German Patent Application (OLS) Nos. 2,541,274 and 2,541,230, JP-B-53-41091 (the term "JP-B" as used herein means an "examined Japanese patent publication") and EP 029104, and the dispersion by an organic solvent-soluble polymer is described in PCT International Application W088/00723.

Examples of the high boiling point solvent which can be used in the oil-in-water dispersion method include phthalic esters (e.g., dibutyl phthalate, dioctyl phthalate, dicyclohexyl phthalate, di-2-ethylhexyl phthalate, decyl phthalate, bis(2,4-di-tert-amylphenyl) isophthalate, bis(1,1-diethylpropyl) phthalate), phosphoric or phosphonic esters (e.g., diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, di-2-ethylhexylphenyl phosphonate), benzoic esters (e.g., 2-ethylhexylbenzoate, 2,4-dichlorobenzoate, dodecylbenzoate, 2-ethylhexyl-p-hydroxybenzoate), amides (e.g., N,N-diethyldodecanamide, N,N-diethyllaurylamide), alcohols or phenols (e.g., isostearyl alcohol, 2,4-di-tert-amylphenol), aliphatic esters (e.g., dibutoxyethyl succinate, di-2-ethylhexyl succinate, 2-hexyldecyl tetradecanate, tributyl citrate, diethyl azelate, isostearyl lactate, trioctyl citrate), aniline derivatives (e.g., N,N-dibutyl-2-butoxy-5-tert-octylaniline), chlorinated paraffins (e.g., paraffins having a chlorine content of from 10 to 80%), trimesic esters (e.g., tributyl trimesinate), dodecylbenzene, diisopropylnaphthalene, phenols (e.g., 2,4-di-tert-amylphenol, 4-dodecyloxyphenol, 4-dodecyloxycarbonylphenol, 4-(4-dodecyloxyphenylsulfonyl)phenol), carboxylic acids (e.g., 2-(2,4-di-tert-amylphenoxylactic acid, 2-ethoxyoctanedecanoic acid) and alkylphosphoric acids (e.g., di-2-(ethylhexol)phosphoric acid, diphenylphosphoric acid). As an auxiliary solvent, an organic solvent having a boiling point of from 30° C. to about 160° C. (e.g., ethyl acetate, butyl acetate, ethyl propionate, methyl ethyl ketone, cyclohexanone, 2-ethoxyethyl acetate, dimethylformamide) may be used in combination.

The high boiling point organic solvent is used at a weight ratio of from 0 to 10.0 times, preferably from 0 to 5.0 time, more preferably from 0.5 to 4.5 times to the coupler.

With respect to the silver halide emulsion or other materials (such as additives) and the photographic constituent layers (such as layer arrangement) for use in the present invention, and in addition, with respect to the processing method for processing the photographic material and additives used in the processing, the silver halide color photographic materials and the processing methods therefor described in EP 0355660A2, JP-A-5-34889 (the term "JP-A" as used herein means an "unexamined published Japanese patent application"), JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, JP-A-6- 43611, JP-A-6-3779, JP-A-6-208196, JP-A-6-118546 and EP 0520457A2 are also preferred.

The silver halide for use in the present invention may have any halogen composition, such as silver chloride, silver bromide, silver chlorobromide, silver iodochlorobromide or silver iodobromide, but in particular, for the purpose of rapid processing, a silver chlorobromide emulsion having a silver chloride content of from 90 mol % to 100 mol %, more preferably from 95 mol % to 100 mol %, most preferably from 98 mol % to 100 mol %, or a pure silver chloride emulsion is preferred.

The present invention will be described below in greater detail with reference to the examples, but of course, the present invention should not be construed as being limited thereto.

EXAMPLE 1

Single-layer Photographic Material 101 for evaluation was prepared using an undercoated polyethylene terephthalate support to have the following layer structure thereon.

(Preparation of Coating Solution for Emulsion Layer)

1.85 mmol of a coupler, 10 ml of ethyl acetate and, based on the coupler, 50 wt % of dibutyl phthalate (solvent) and 50 wt % of trioctylphosphate (solvent) were mixed and dissolved. The resulting solution was emulsion-dispersed in 33 g of a 14% aqueous gelatin solution containing 3 ml of a 10% sodium dodecylbenzenesulfonate. Separately, a silver chlorobromide emulsion (cubic; a 3:7 (by mol as silver) mixture of a large-size emulsion and a small-size emulsion having an average grain size of 0.88 μm and 0.70 μm, respectively; the coefficients of variation in the grain size distribution being 0.08 and 0.10, respectively; each size emulsion containing 0.3 mol % of silver bromide localized on a part of the grain surface). The emulsion was subjected to chemical ripening by adding a sulfur sensitizer and a gold sensitizer. This emulsion and the emulsified dispersion prepared above were mixed and dissolved to prepare a coating solution for an emulsion layer having the following composition. As a hardening agent, sodium 1-oxy-3,5 -dichloro-s-triazinate was used.

(Layer Structure)

The layer structure of the sample used in this example is described below (the numerals show the coating amount per $m^2$).

| | |
|---|---|
| [Support] | |
| Polyethylene terephthalate support | |
| [Emulsion Layer] | |
| Silver chlorobromide emulsion (described above) | 3.0 mmol |
| Coupler (coupler described in Table A) | 1.0 mmol |
| Tricresyl phosphate | (50 wt % to the coupler) |
| Trioctyl phosphate | (50 wt % to the coupler) |
| Gelatin | 5.5 g |
| [Protective Layer] | |
| Gelatin | 2.5 g |
| Acryl-modified copolymer of polyvinyl alcohol (modification degree: 17%) | 0.15 g |
| Liquid paraffin | 0.03 g |

The couplers for comparison used in this example had the structures shown below (as for the structures of the couplers of the present invention, examples of the coupler described above may be referred to).

(Comparative Couplers)

Ex-1

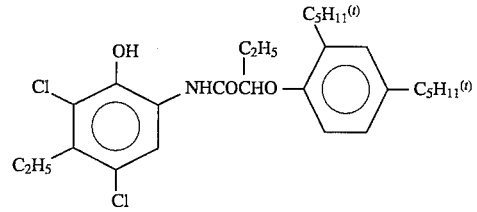

-continued

Ex-2

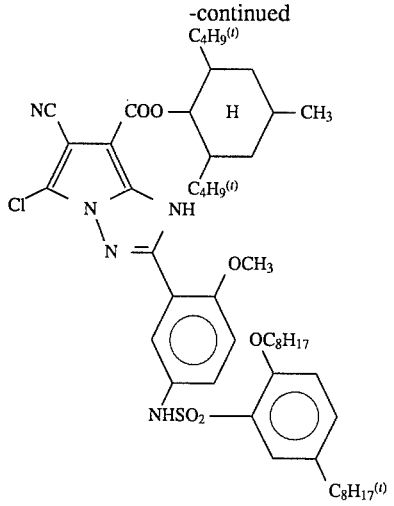

Ex-3

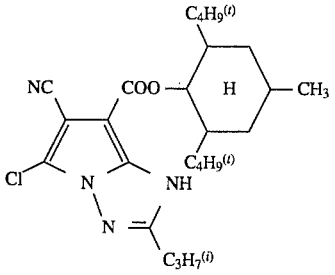

Ex-4

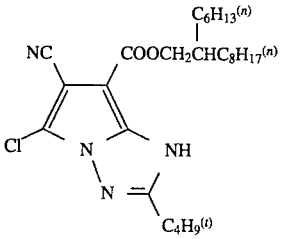

Samples 102 and 126 were prepared thoroughly in the same manner as Sample 101 except that the cyan coupler of Sample 101 was replaced by ½ molar amount of couplers shown in Table A and the amount of the silver halide was also reduced to ½.

Each of the samples was subjected to gradation exposure using an optical wedge and processed through the following processing steps with the processing solutions described below.

| Processing Step | Temperature (°C.) | Time (sec.) |
|---|---|---|
| Color Development | 35 | 40 |
| Bleach-Fixing | 35 | 60 |
| Water Washing | 35 | 120 |

-continued (Composition of Processing Solution)

| | |
|---|---|
| [Color Developer] | |
| Distilled water | 800 ml |
| Triethanolamine | 8.1 g |
| Diethylhydroxylamine | 4.2 g |
| Potassium bromide | 0.05 g |
| Sodium chloride | 0.5 g |
| Sodium hydrogencarbonate | 3.9 g |
| Sodium sulfite | 0.13 g |
| N-Ethyl-N-(β-methanesulfonamidoethyl)-3-methyl-4-aminoaniline sulfate | 5.0 g |
| Potassium carbonate | 18.7 g |
| Water to make | 1,000 ml |
| pH | 10.15 |
| [Bleach-Fixing Solution] | |
| Distilled water | 400 ml |
| Ammonium thiosulfate (700 g/l) | 150 ml |
| Sodium sulfate | 18.0 g |
| Ammonium ethylenediaminetetraacetato iron (III) | 55.0 g |
| Sodium ethylenediaminetetraacetate | 5.0 g |
| Water to make | 1,000 ml |
| pH | 6.70 |

Each of the processed samples was determined on the optical density of red light to obtain the maximum color density, Dmax. Also, the yellow density at the point giving the cyan density of 1.0 was determined by means of X-Rite 310 Densitometer (manufactured by X-Rite Company). The lower the yellow density, the less the side adsorption and the superior the hue. Then, each of the samples was subjected to light irradiation for 5 days by an Xe light source of 200,000 lux (intermittent irradiation of five-hour brightness/one-hour darkness) through a sharp cut filter capable of cutting about 50% of the light at 390 nm. After the light irradiation, each sample was again determined on the optical density of red light to obtain a dye image residual rate after light irradiation. The dye image residual rate was evaluated at two points, i.e., the Dmax part and a low density part showing a color density ⅕ the Dmax, and the results are shown in Table A by a percentage to the initial density as 100%.

TABLE A

| | | | | Dye Image Residual Rate | | |
|---|---|---|---|---|---|---|
| Sample No. | Coupler | Hue (Y/C) | Dmax | Dmax | ⅕ Dmax | Remarks |
| 101 | Ex-1 | 0.250 | 2.04 | 88 | 84 | Comparison |
| 102 | Ex-2 | 0.173 | 2.14 | 85 | 56 | " |
| 103 | Ex-3 | 0.172 | 2.09 | 89 | 67 | " |
| 104 | Ex-4 | 0.172 | 2.11 | 91 | 66 | " |

TABLE A-continued

| Sample No. | Coupler | Hue (Y/C) | Dmax | Dye Image Residual Rate Dmax | Dye Image Residual Rate ⅕ Dmax | Remarks |
|---|---|---|---|---|---|---|
| 105 | (32) | 0.172 | 2.21 | 87 | 80 | Invention |
| 106 | (13) | 0.172 | 2.16 | 91 | 88 | " |
| 107 | (44) | 0.172 | 2.18 | 92 | 91 | " |
| 108 | (1) | 0.173 | 2.24 | 90 | 89 | " |
| 109 | (2) | 0.175 | 2.18 | 89 | 87 | " |
| 110 | (3) | 0.171 | 2.21 | 85 | 82 | " |
| 111 | (5) | 0.173 | 2.11 | 87 | 87 | " |
| 112 | (7) | 0.174 | 2.25 | 88 | 86 | " |
| 113 | (10) | 0.172 | 2.17 | 84 | 81 | " |
| 114 | (12) | 0.173 | 2.06 | 87 | 85 | " |
| 115 | (14) | 0.171 | 2.19 | 91 | 90 | " |
| 116 | (19) | 0.173 | 2.21 | 92 | 91 | " |
| 117 | (20) | 0.172 | 2.18 | 89 | 88 | " |
| 118 | (23) | 0.175 | 2.09 | 90 | 88 | " |
| 119 | (30) | 0.174 | 2.04 | 87 | 86 | " |
| 120 | (37) | 0.171 | 2.26 | 94 | 93 | " |
| 121 | (38) | 0.176 | 2.25 | 93 | 91 | " |
| 122 | (41) | 0.178 | 2.17 | 91 | 90 | " |
| 123 | (43) | 0.172 | 2.20 | 92 | 90 | " |
| 124 | (46) | 0.173 | 2.19 | 89 | 86 | " |
| 125 | (47) | 0.171 | 2.15 | 90 | 87 | " |
| 126 | (48) | 0.173 | 2.08 | 85 | 85 | " |

As is clearly seen from Table A, Samples 102 to 126 showed excellent hue as compared with Sample 101. However, Samples 102 to 104 showed outstandingly poor light fastness at the low density part and these were apparently inferior to Comparative Sample 101. On the other hand, Samples 105 to 107, which used the couplers of the present invention resulting from changing only the releasing group of the couplers of Samples 102 to 104, showed not only excellent hue but also improved light fastness at the low density part to provide almost the same residual rate as that at the high density part. Samples 108 to 126 showed similar results. Thus, the coupler of the present invention is apparently superior in view of the hue and the light fastness.

Each of Samples 101 to 126 was exposed and processed in the same manner as above and stored under the condition of 100° C. for 10 days to evaluate the dye image residual rate at the maximum color density. The results are shown in Table B.

TABLE B

| Sample No. | Coupler | Dye Image Residual Rate (100° C.) | Remarks |
|---|---|---|---|
| 101 | Ex-1 | 64 | Comparison |
| 102 | Ex-2 | 87 | " |
| 103 | Ex-3 | 89 | " |
| 104 | Ex-4 | 81 | " |
| 105 | (32) | 94 | Invention |
| 106 | (13) | 96 | " |
| 107 | (44) | 91 | " |
| 108 | (1) | 95 | " |
| 109 | (2) | 93 | " |
| 110 | (3) | 90 | " |
| 111 | (5) | 88 | " |
| 112 | (7) | 91 | " |
| 113 | (10) | 92 | " |
| 114 | (12) | 92 | " |
| 115 | (14) | 95 | " |
| 116 | (19) | 94 | " |
| 117 | (20) | 91 | " |
| 118 | (23) | 89 | " |
| 119 | (30) | 87 | " |

TABLE B-continued

| Sample No. | Coupler | Dye Image Residual Rate (100° C.) | Remarks |
|---|---|---|---|
| 120 | (37) | 96 | " |
| 121 | (38) | 94 | " |
| 122 | (41) | 93 | " |
| 123 | (43) | 87 | " |
| 124 | (46) | 85 | " |
| 125 | (47) | 84 | " |
| 126 | (48) | 88 | " |

It is seen from Table B that Samples 105 to 107 using couplers of the present invention were of course excellent in heat fastness as compared with Sample 101 using Comparative Coupler Ex-1 but they also showed further improved fastness as compared with Samples 102 to 104 using corresponding chlorine atom-releasing couplers. Samples 108 to 126 using couplers of the present invention showed similarly excellent heat fastness.

EXAMPLE 2

A multi-layer color printing paper (201) was prepared by applying corona discharge to the surface of a paper support of which both surfaces were laminated with polyethylene, then providing thereon a gelatin undercoat layer containing sodium dodecylbenzenesulfonate and further coating thereon various photographic constituent layers to have the following layer structure. The coating solutions were prepared as follows.

Preparation of Coating Solution for the Fifth Layer 310 g of Cyan Coupler (ExC), 100 g of Dye Image Stabilizer (Cpd-1), 100 g of Dye Image Stabilizer (Cpd-5), 10 g of Dye Image Stabilizer (Cpd-6), 10 g of Dye Image Stabilizer (Cpd-8), 100 g of Dye Image Stabilizer (Cpd-9), 100 g of Dye Image Stabilizer (Cpd-10), 100 g of Ultraviolet Absorbent (UV-2), 250 g of Solvent (Solv-2) and 250 g of Solvent (Solv-4) were dissolved in 360 ml of ethyl acetate and the resulting solution was emulsion-dispersed in 2,000 g of a 16% gelatin aqueous solution containing 60 ml of 10% sodium dodecylbenzenesulfonate and 10 g of citric acid to prepare Emulsified Dispersion C. Separately, Silver Chlorobromide Emulsion C (cubic; a 1:4 (by mol as silver) mixture of Large-Size Emulsion C and Small-Size Emulsion C having an average grain size of 0.50 μm and 0.41 μm, respectively; the coefficients of variation in the grain size distribution being 0.09 and 0.11, respectively; each size emulsion comprising silver halide grains containing 0.8 mol % of silver bromide localized on a part of the grain surface with the remainder being silver chloride) was prepared. In this emulsion, Red-Sensitive Sensitizing Dyes G and H were added to Large-Size Emulsion C in an amount of $1.0\times10^{-4}$ mol/mol-Ag and $5.0\times10^{-5}$ mol/mol-Ag, respectively, and to Small-Size Emulsion C in an amount of $1.2\times10^{-4}$ mol/mol-Ag and $6.0\times10^{-5}$ mol/mol-Ag, respectively. This emulsion was subjected to optimal chemical ripening by adding a sulfur sensitizer and a gold sensitizer. The resulting Silver Chlorobromide Emulsion C and Emulsified Dispersion C prepared above were mixed and dissolved to prepare the coating solution for the fifth layer having the following composition.

The coating solutions for the first to seventh layers exclusive of the fifth layer were prepared in the same manner as the coating solution for the fifth-layer. In each layer, 1-oxy-3,5-dichloro-s-triazine sodium salt was used as a gelatin hardening agent.

Also, Compounds Cpd-14 and Cpd-15 were added to each layer to give a total amount of 25.0 mg/m$^2$ and 50.0 mg/m$^2$.

In the silver chlorobromide emulsion of light-sensitive emulsion layers, the spectral sensitizing dyes shown below were used respectively.

Blue-Sensitive Emulsion Layer:

Sensitizing Dye A

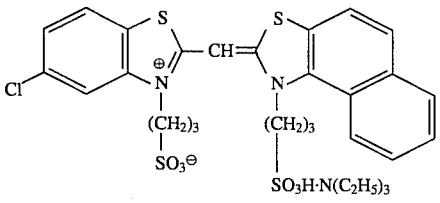

and

-continued

Sensitizing Dye B

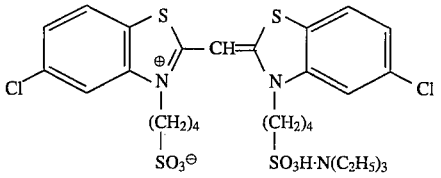

and

Sensitizing Dye C

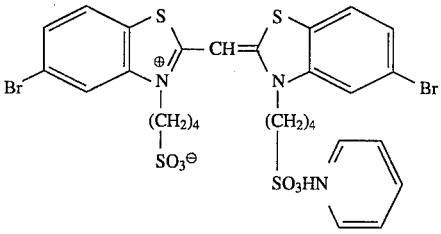

(each sensitizing dye was added in an amount of $1.4\times10^{-4}$ mol to the large-size emulsion and $1.7\times10^{-4}$ mol to the small-size emulsion, per mol of silver halide).

Green-Sensitive Emulsion Layer:

Sensitizing Dye D

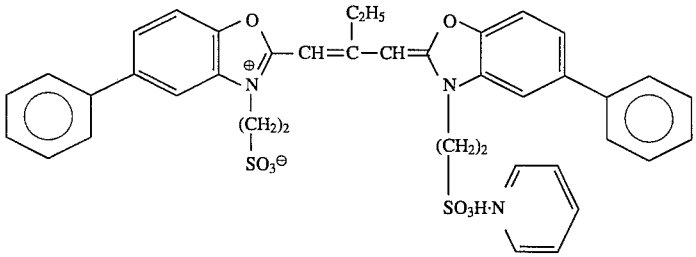

(added in an amount of $3.0\times10^{-4}$ mol to the large-size emulsion and $3.6\times10^{-4}$ mol to the small-size emulsion, per mol of silver halide), Sensitizing Dye E

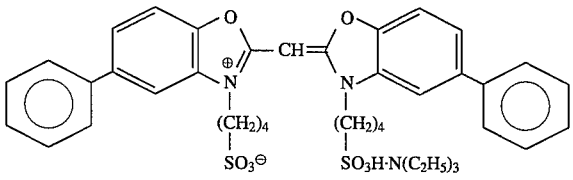

(added in an amount of $4.0\times10^{-5}$ mol to the large-size emulsion and $7.0\times10^{-5}$ mol to the small-size emulsion, per mol of silver halide), Sensitizing Dye F

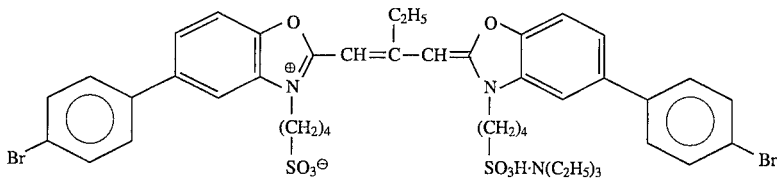

(added in an amount of $2.0\times10^{-4}$ tool to the large-size emulsion and $2.8\times10^{-4}$ mol to the small-size emulsion, per mol of silver halide).

Red-Sensitive Emulsion Layer:

Sensitizing Dye G

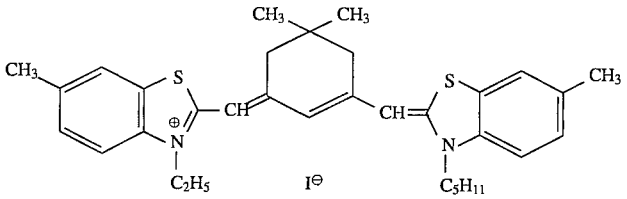

(added in an amount of $1.0\times10^{-4}$ mol to the large-size emulsion and $1.2\times10^{-4}$ mol to the small-size emulsion, permol of silver halide), Sensitizing Dye H

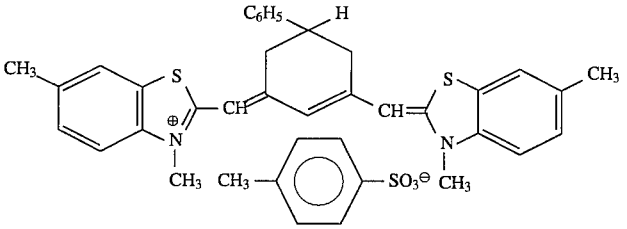

(added in an amount of $5.0\times10^{-5}$ mol to the large-size emulsion and $6.0\times10^{-5}$ mol to the small-size emulsion, per mol of silver halide).

Further, the following compound was added to the red-sensitive emulsion layer in an amount of $2.6\times10^{-3}$ mol per mol of silver halide:

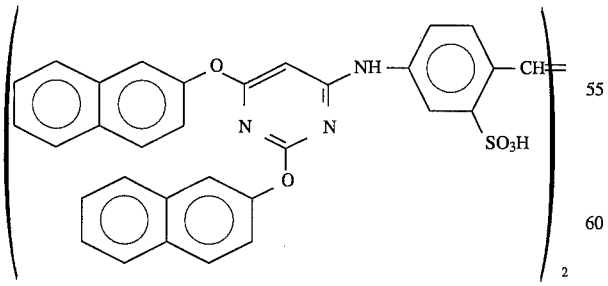

Further, 1-(5-methylureidophenyl)-5-mercaptotetrazole was added to the blue-sensitive emulsion layer, the green-sensitive emulsion layer and the red-sensitive emulsion layer in an amount of $8.5\times10^{-5}$ mol, $7.7\times10^{-4}$ mol and $2.5\times10^{-4}$ mol, respectively, per mol of silver halide.

Also, 4-hydroxy-6-methyl-1,3,3a,7-tetrazaindene was added to the blue-sensitive emulsion layer and the green-sensitive emulsion layer in an amount of $1\times10^{-4}$ mol and $2\times10^{-4}$ mol, respectively, per mol of silver halide. Further, the following dyes (in the parentheses, the coating amounts are shown) were added to the emulsion layers for the purpose of preventing irradiation.

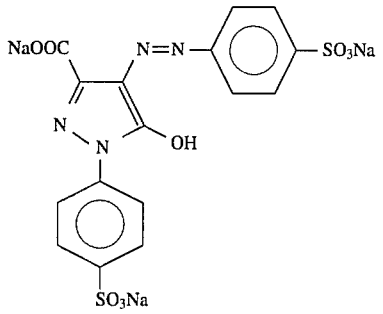

(10 mg/m²)

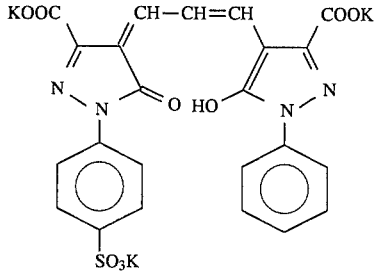

(10 mg/m²)

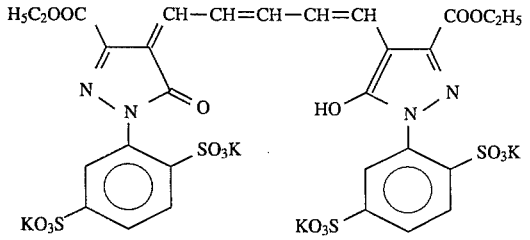

(40 mg/m²)

and

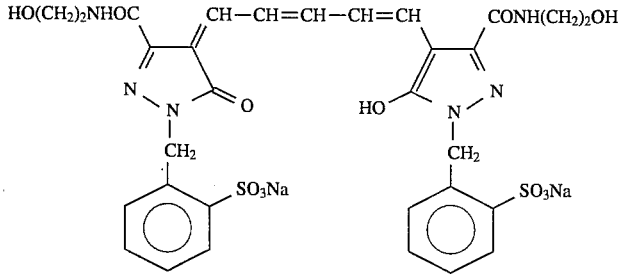

(20 mg/m²)

(Layer Structure)

The structure of each layer is shown below. The numerals show the coating amount (g/m²). In the case of silver halide emulsions, the coating amount in terms of silver is shown.

| | |
|---|---|
| Support | |
| Polyethylene laminated paper [Polyethylene on the first layer side contained 14 wt % of a white pigment ($TiO_2$) and a bluish dye (ultra-marine).] | |
| First Layer (Blue-sensitive Emulsion Layer) | |
| Silver chlorobromide (cubic; a 3:7 (Ag molar ratio) mixture of Large-Size Emulsion A and Small-Size Emulsion A having an average grain size of 0.88 μm and 0.70 μm, respectively; the coefficients of variation in the grain size distribution being 0.08 and 0.10, respectively; each size emulsion comprising silver halide containing 0.3 mol % of AgBr localized on a part of the grain surface with the remainder being silver chloride) | 0.30 |
| Gelatin | 1.46 |
| Yellow Coupler (ExY) | 0.68 |
| Dye Image Stabilizer (Cpd-1) | 0.10 |
| Dye Image Stabilizer (Cpd-2) | 0.05 |
| Dye Image Stabilizer (Cpd-3) | 0.12 |
| Solvent (Solv-1) | 0.20 |
| Solvent (Solv-5) | 0.05 |
| Second Layer (Color Mixing Preventing Layer) | |
| Gelatin | 1.10 |
| Color Mixing Inhibitor (Cpd-4) | 0.10 |
| Solvent (Solv-7) | 0.05 |
| Solvent (Solv-2) | 0.15 |
| Solvent (Solv-3) | 0.30 |
| Solvent (Solv-1) | 0.05 |
| Third Layer (Green-sensitive Emulsion Layer) | |
| Silver chlorobromide (cubic; a 1:3 (Ag molar ratio) mixture of Large-Size Emulsion B and Small-Size Emulsion B | 0.13 |

-continued

| | |
|---|---|
| having an average grain size of 0.55 μm and 0.39 μm, respectively; the coefficients of variation in the grain size distribution being 0.10 and 0.08, respectively; each size grain comprising silver halide containing 0.8 mol % of AgBr localized on a part of the grain surface with the remainder being silver chloride) | |
| Gelatin | 1.45 |
| Magenta Coupler (ExM) | 0.18 |
| Dye Image Stabilizer (Cpd-5) | 0.02 |
| Dye Image Stabilizer (Cpd-2) | 0.01 |
| Dye Image Stabilizer (Cpd-6) | 0.01 |
| Dye Image Stabilizer (Cpd-7) | 0.01 |
| Dye Image Stabilizer (Cpd-8) | 0.08 |
| Ultraviolet Absorbent (UV-1) | 0.15 |
| Solvent (Solv-3) | 0.80 |
| Fourth Layer (Color Mixing Preventing Layer) | |
| Gelatin | 0.88 |
| Color Mixing Inhibitor (Cpd-4) | 0.08 |
| Solvent (Solv-7) | 0.04 |
| Solvent (Solv-2) | 0.12 |
| Solvent (Solv-3) | 0.24 |
| Solvent (Solv-1) | 0.04 |
| Fifth Layer (Red-sensitive Emulsion Layer) | |
| Silver chlorobromide emulsion (cubic; a 1:4 (Ag molar ratio) mixture of Large-Size Emulsion C and Small-Size Emulsion C having an average grain size of 0.50 μm and 0.41 μm, respectively; the coefficients of variation in the grain size distribution being 0.09 and 0.11, respectively; each size emulsion comprising silver halide grain containing 0.8 mol % of AgBr localized on a part of the grain surface with the remainder being silver chloride) | 0.20 |
| Gelatin | 1.40 |
| Cyan Coupler (ExC) | 0.31 |
| Ultraviolet Absorbent (UV-2) | 0.10 |
| Dye Image Stabilizer (Cpd-9) | 0.10 |
| Additive (Cpd-10) | 0.10 |
| Dye Image Stabilizer (Cpd-5) | 0.10 |
| Solvent (Solv-2) | 0.25 |
| Dye Image Stabilizer (Cpd-8) | 0.01 |
| Dye Image Stabilizer (Cpd-6) | 0.01 |
| Solvent (Solv-4) | 0.25 |
| Dye Image Stabilizer (Cpd-1) | 0.10 |
| Sixth Layer (Ultraviolet Absorbing Layer) | |
| Gelatin | 0.55 |
| Ultraviolet Absorbent (UV-1) | 0.38 |
| Dye Image Stabilizer (Cpd-12) | 0.15 |
| Dye Image Stabilizer (Cpd-5) | 0.02 |
| Seventh Layer (Protective Layer) | |
| Gelatin | 1.13 |
| Acryl-modified copolymer of polyvinyl alcohol (modification degree: 17%) | 0.05 |
| Liquid paraffin | 0.02 |
| Dye Image Stabilizer (Cpd-13) | 0.01 |

Yellow Coupler (ExY)

A 1:1 (by mol) mixture of:

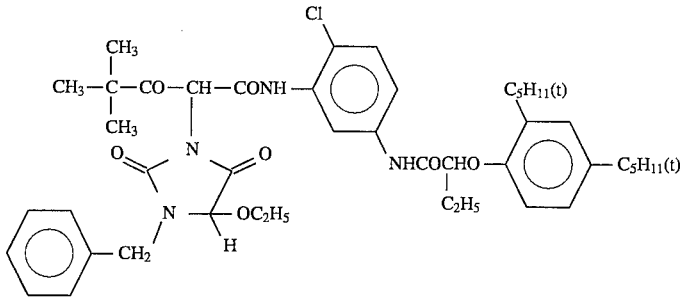

and

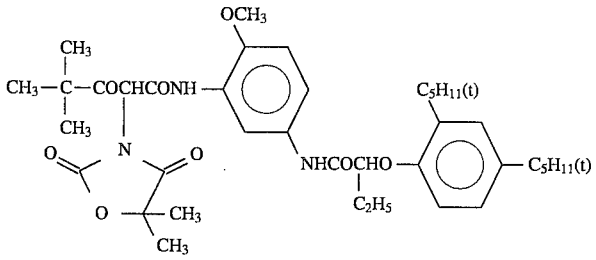

Cyan Coupler (ExC)

A 25:75 (by mol) mixture of

-continued
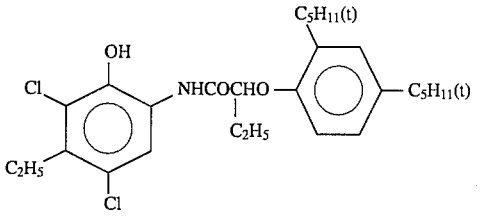
and
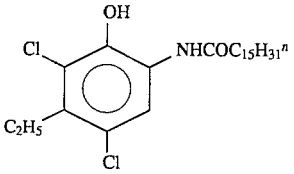
Magenta Coupler (ExM)
A 1:1 (by mol) mixture of
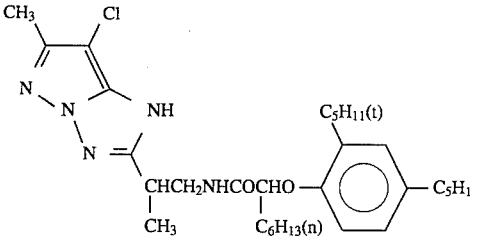
and
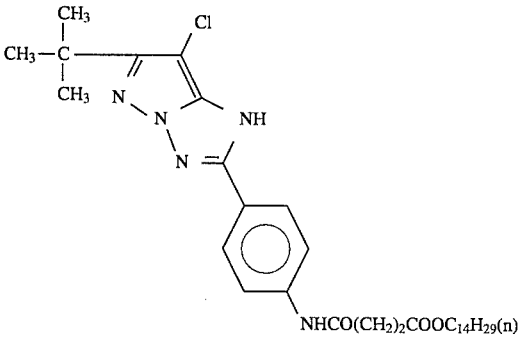
Dye Image Stabilizer (Cpd-1)
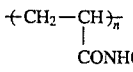
Number average molecular weight: 60,000
Dye Image Stabilizer (Cpd-2)
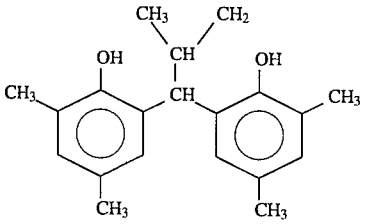
Dye Image Stabilizer (Cpd-3)

-continued
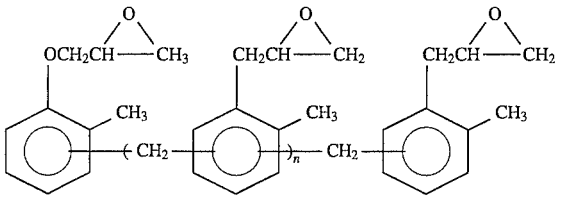
( n = 7 to 8 (on average))
Color Mixing Inhibitor (Cpd-4)
A 1:1 (by mol) mixture of (1) and (2):
(1)
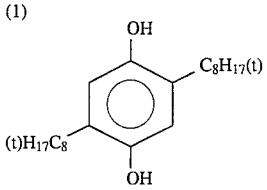
(HQ-1)
(2)
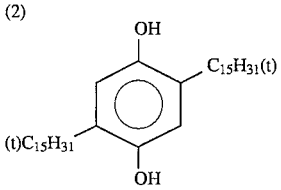
(HQ-2)
Dye Image Stabilizer (Cpd-5)
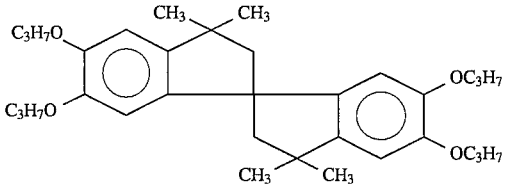
Dye Image Stabilizer (Cpd-6)
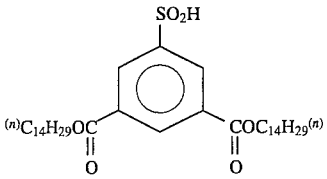
Dye Image Stabilizer (Cpd-7)
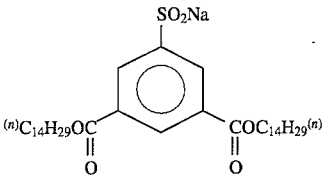
Dye Image Stabilizer (Cpd-8)
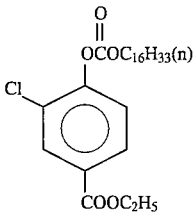
Dye Image Stabilizer (Cpd-9)
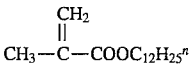
Additive (Cpd-10)
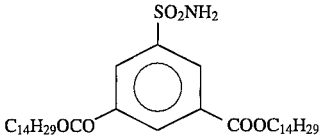
Dye Image Stabilizer (Cpd-12)

-continued
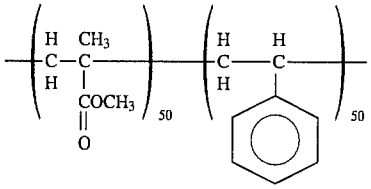
Average Molecular weight: about 60,000
Dye Image Stabilizer (Cpd-13)
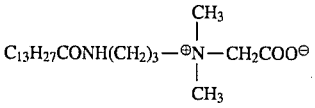
Antiseptic (Cpd-14)
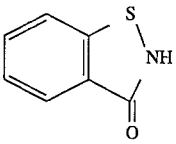
Antiseptic (Cpd-15)
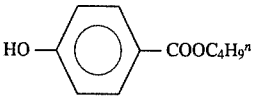
Ultraviolet Absorbent (UV-1)
A 1:5:10:5 (by weight) mixture of (1), (2), (3) and (4):
(1)
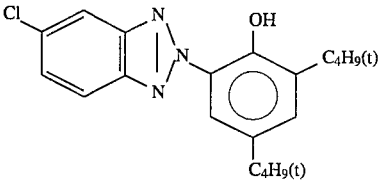
(2)
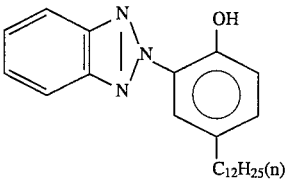
(3)
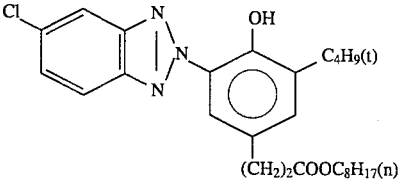
(4)
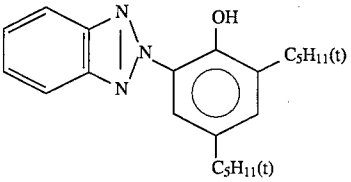
Ultraviolet Absorbent (UV-2)
A 1:2:2 (by weight) mixture of (1), (2) and (3):
(1)
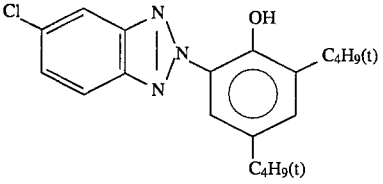
(2)
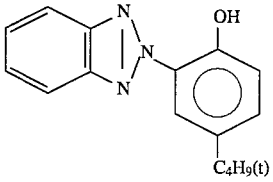

-continued (3)

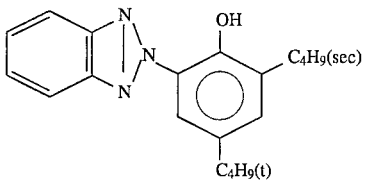

Solvent (Solv-1)

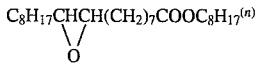

Solvent (Solv-2)

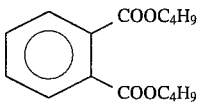

Solvent (Solv-3)

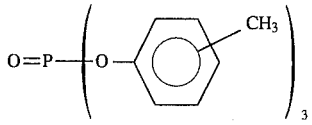

Solvent (Solv-4)

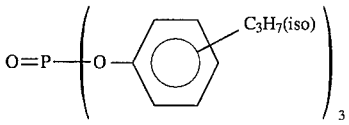

Solvent (Solv-5)

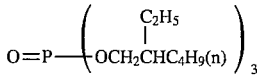

Solvent (Solv-7)

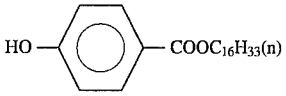

Samples 202 to 210 were prepared thoroughly in the same manner as Sample 201 except that the cyan coupler of Sample 201 was replaced by ½ molar amount of the couplers shown in Table C and the coating amount of the silver halide emulsion was reduced to ½.

First, Sample 210 was rolled into a 127-mm width and exposed such that about 35% of the coated silver amount was developed using a sensitometer (Model FWH, manufactured by Fuji Photo film Co., Ltd.; color temperature of the light source: 3,200° K) to give a gray color.

Thereafter, the sample was subjected to a continuous processing (running test) through the following processing steps using a printer processor, PP1820V, manufactured by Fuji Photo Film Co., Ltd. until the replenishing amount reached two times the tank volume of the color developer.

| Processing Step | Temperature (°C.) | Time (sec.) | Replenishing Amount* (ml) |
|---|---|---|---|
| Color development | 38.5 | 45 | 73 |
| Bleach-fixing | 35 | 45 | 60** |
| Rinsing (1) | 35 | 30 | — |
| Rinsing (2) | 35 | 30 | — |
| Rinsing (3) | 35 | 30 | 360 |
| Drying | 80 | 60 | |

*Replenishing amount was per 1 $m^2$ of photographic material.
**In addition to 60 ml as shown above, 120 ml was flowed in from Rinsing (1) per 1 $m^2$ of photographic material.
(The rinsing was in a 3-tank countercurrent system from Rinsing (3) to Rinsing (1).)

Each processing solution had the following composition.

| | Tank Solution | Replenisher |
|---|---|---|
| [Color Developer] | | |
| Water | 800 ml | 800 ml |
| Ethylenediaminetetraacetic acid | 3.0 g | 3.0 g |
| Disodium 4,5-dihydroxy-benzene-1,3-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent brightening agent (WHITEX 4, produced by Sumitomo Chemical Co., Ltd.) | 1.0 g | 3.0 g |
| Sodium sulfite | 0.1 g | 0.1 g |
| Disodium-N,N-bis(sulfnato-ethyl)hydroxylamine | 5.0 g | 10.0 g |
| Sodium triisopropyl-naphthalene (β) sulfonate | 0.1 g | 0.1 g |
| N-Ethyl-N-(β-methanesulfon-amidoethyl)-3-methyl-4-amino-aniline.3/2 sulfuric acid monohydrate | 5.0 g | 11.5 g |
| Water to make | 1,000 ml | 1,000 ml |
| pH (25° C., adjusted by potassium hydroxide and sulfuric acid) | 10.00 | 11.00 |
| [Bleach-fixing Solution] | | |
| Water | 600 ml | 150 ml |
| Ammonium thiosulfate (750 g/liter) | 93 ml | 230 ml |
| Ammonium sulfite | 40 g | 100 g |
| Ammonium ethylenediamine-tetraacetato iron (III) | 55 g | 135 g |

| | | |
|---|---|---|
| Ethylenediaminetetraacetic acid | 5 g | 12.5 g |
| Nitric acid (67%) | 30 g | 65 g |
| Water to make | 1,000 ml | 1,000 ml |
| pH (25° C., adjusted by acetic acid and aqueous ammonia) | 5.8 | 5.6 |
| [Rinsing Solution] (The tank solution and the replenisher were same.) | | |
| Sodium chlorinated isocyanurate | 0.02 g | |
| Deionized water (electro-conductivity: 5 μs/cm or less) | 1,000 ml | |
| pH | 6.5 | |

Then, each of Samples 201 to 210 was subjected to gradation exposure by red light through an optical wedge and processed with the above-described processing solutions. Each sample was evaluated on the dye image fastness in the conditions of under light irradiation for 14 days by an Xe light source of 100,000 lux (intermittent irradiation of five-hour brightness/one-hour darkness) and of at 100° C. for 14 days. The light fastness was evaluated at two points of the initial density being 2.0 and 0.5 and the heat fastness was evaluated at the initial density of 2.0. The results obtained are shown in Table C.

The heat fastness was determined by a blue optical density on the change in the colored amount of the white background and it is also shown as ΔDmin in Table C.

TABLE C

| | | Light Fastness | | Heat Fastness | | |
|---|---|---|---|---|---|---|
| Sample No. | Coupler | D = 2.0 (%) | D = 0.5 (%) | D = 2.0 (%) | Δ Dmin | Remarks |
| 201 | Ex C | 84 | 80 | 52 | 0.16 | Comparison |
| 202 | Ex-2 | 81 | 59 | 84 | 0.12 | " |
| 203 | Ex-3 | 86 | 72 | 88 | 0.27 | " |
| 204 | Ex-4 | 87 | 70 | 80 | 0.24 | " |
| 205 | (32) | 84 | 81 | 85 | 0.11 | Invention |
| 206 | (13) | 88 | 86 | 89 | 0.12 | " |
| 207 | (44) | 89 | 86 | 84 | 0.13 | " |
| 208 | (37) | 92 | 88 | 91 | 0.11 | " |
| 209 | (39) | 88 | 85 | 88 | 0.13 | " |
| 210 | (26) | 90 | 87 | 85 | 0.14 | " |

It is seen from Table C that Samples 205 to 210 using the coupler of the present invention were superior to Sample 201 particularly in view of heat fastness, to Sample 202 particularly in view of light fastness at the low density part and to Samples 203 and 204 in view of light fastness and in addition, heat stains, and that they are apparently excellent in view of total performance.

Then, in order to examine the change in the photographic performance due to the fluctuation in the processing of Samples 201 to 210, the photographic performance was compared between the case where a bleach-fixing solution was added to the color developer at a ratio of 0.5 cc of the bleach-fixing solution to 1 l of the color developer and the case where the bleach-fixing solution was not added. The evaluation was shown by the change in the red light density at the density of 2.0.

TABLE D

| Sample | Coupler | Δ D | Remarks |
|---|---|---|---|
| 201 | Ex C | +0.08 | Comparison |
| 202 | Ex-2 | −0.13 | " |

TABLE D-continued

| Sample | Coupler | Δ D | Remarks |
|---|---|---|---|
| 203 | Ex-3 | −0.08 | " |
| 204 | Ex-4 | −0.17 | " |
| 205 | (32) | +0.02 | Invention |
| 206 | (13) | −0.01 | " |
| 207 | (44) | −0.02 | " |
| 208 | (37) | ±0.00 | " |
| 209 | (39) | +0.02 | " |
| 210 | (26) | −0.03 | " |

It is seen from Table D that Samples 205 to 210 using the coupler of the present invention showed small change in the color density when the bleach-fixing solution mingled in the color developer and thus they are excellent photographic materials. Such mingling of the processing solution often occurs in the present processing system on the market and the photographic material of the present invention can be said to show stable performance even at the above-described use on the market.

As is described in the foregoing, by using the coupler of the present invention, a photographic material having excellent hue, light fastness and heat fastness and low in the processing fluctuation can be provided.

EXAMPLE 3

Samples 301 to 310 were prepared thoroughly in the same manner as Samples 201 to 210 except for changing the composition of the first layer of Samples 201 to 210 in Example 2 as follows.

| First Layer (Blue-sensitive Emulsion Layer) | |
|---|---|
| Silver chlorobromide (cubic; a 3:7 (Ag molar ratio) mixture of Large-Size Emulsion A and Small-Size Emulsion A having an average grain size of 0.88 μm and 0.70 μm, respectively; the coefficients of variation in the grain size distribution being 0.08 and 0.10, respectively; each size emulsion comprising silver halide containing 0.3 mol % of AgBr localized on a part of the grain surface with the remainder being silver chloride) | 0.30 |
| Gelatin | 1.46 |
| Yellow Coupler (ExY-2) | 0.60 |
| Dye Image Stabilizer (Cpd-11) | 0.20 |
| Dye Image Stabilizer (Cpd-2) | 0.05 |

-continued

| First Layer (Blue-sensitive Emulsion Layer) | |
|---|---|
| Dye Image Stabilizer (Cpd-3) | 0.12 |
| Dye Image Stabilizer (Cpd-5) | 0.05 |
| Solvent (Solv-3) | 0.12 |
| Solvent (Solv-5) | 0.12 |

-continued

| First Layer (Blue-sensitive Emulsion Layer) | |
|---|---|
| AgBr localized on a part of the grain surface with the remainder being silver chloride) | |
| Gelatin | 1.46 |
| Yellow Coupler (ExY-3) | 0.55 |

A 1:1 (by mol) mixture of:

ExY-2

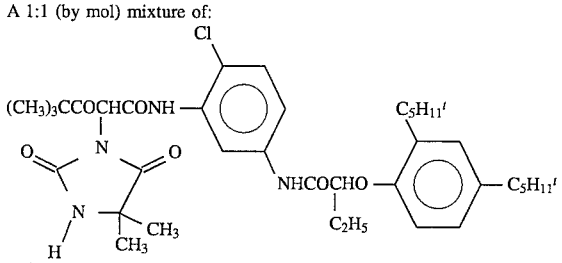

and

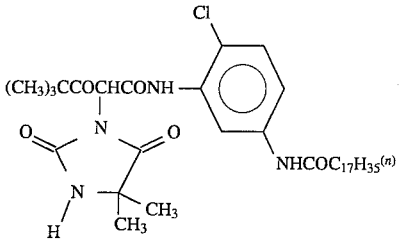

Cpd-11

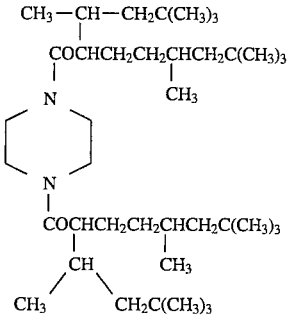

The thus-prepared samples were evaluated thoroughly in the same manner as in Example 2 and then it is seen that the photographic materials using the coupler of the present invention were excellent in view of the hue, the light fastness, the heat fastness and the processing dependency the same as shown in Example 2.

EXAMPLE 4

Samples 401 to 410 were prepared thoroughly in the same manner Samples 201 to 210 except for changing the composition of the first layer of Samples 201 to 210 in Example 2 as follows.

| First Layer (Blue-sensitive Emulsion Layer) | |
|---|---|
| Silver chlorobromide (cubic; a 3:7 (Ag molar ratio) mixture of Large-Size Emulsion A and Small-Size Emulsion A having an average grain size of 0.88 μm and 0.70 μm, respectively; the coefficients of variation in the grain size distribution being 0.08 and 0.10, respectively; each size emulsion comprising silver halide containing 0.3 mol % of | 0.30 |

-continued

| First Layer (Blue-sensitive Emulsion Layer) | |
|---|---|
| Dye Image Stabilizer (Cpd-16) | 0.35 |
| Dye Image Stabilizer (Cpd-2) | 0.05 |
| Dye Image Stabilizer (Cpd-3) | 0.12 |
| Dye Image Stabilizer (Cpd-5) | 0.05 |
| Solvent (Solv-8) | 0.20 |
| Solvent (Solv-3) | 0.05 |

A 1:1 (by mol) mixture of:

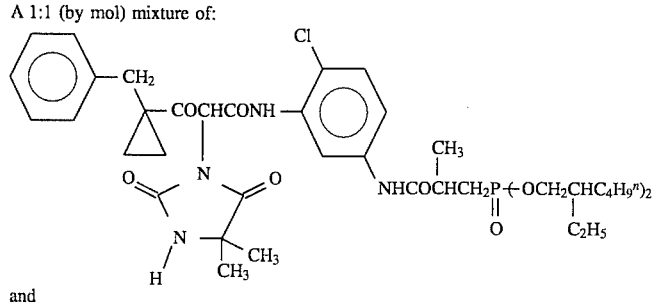

(ExY-3)

and

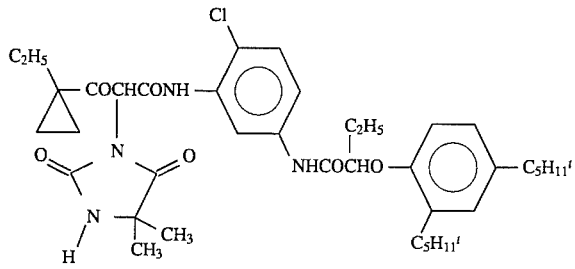

(Cpd-16)

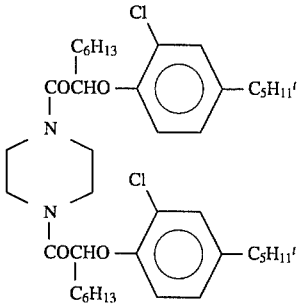

(Solv-8)

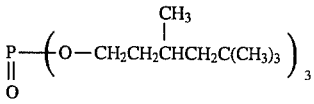

The thus-prepared samples were evaluated thoroughly in the same manner as in Example 2 and it is seen that the photographic materials using the coupler of the present invention were excellent in view of the hue, the light fastness, the heat fastness and the processing dependency the same as shown in Example 2.

EXAMPLE 5

Sample 501 was prepared in the same manner as Sample 101 in Example 1 of JP-A-6-3779. Samples 502 to 510 were prepared thoroughly in the same manner as Sample 501 except for replacing the Coupler C-3 in the fourth, fifth and sixth layers of Sample 501 by an equimolar amount of the couplers described in Table E.

C-3

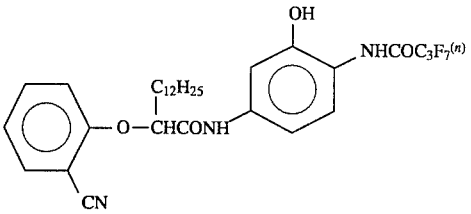

Each of the samples prepared as above was imagewise exposed and subjected to the development processing described in Example 1 of JP-A-6-3779.

After the above-described processing, each sample was evaluated on the dye image fastness in the conditions of under irradiation of an Xe light source of 100,000 lux (intermittent irradiation of 5-hour brightness/one-hour darkness) for 10 days and of at 100° C. for 14 days. The light fastness was evaluated at two points of the initial density being 2.0 and 0.5 and the heat fastness was evaluated at the initial density of 2.0. The results obtained are shown in Table E.

TABLE E

| Sample | | Light Fastness | | Heat | |
|---|---|---|---|---|---|
| No. | Coupler | D = 2.0 | D = 0.5 | Fastness | Remarks |
| 501 | C-3 | 80 | 77 | 54 | Comparison |
| 502 | Ex-2 | 77 | 59 | 60 | " |
| 503 | Ex-3 | 81 | 65 | 62 | " |
| 504 | Ex-4 | 80 | 66 | 64 | " |
| 505 | (32) | 82 | 80 | 67 | Invention |
| 506 | (13) | 80 | 79 | 70 | " |
| 507 | (44) | 81 | 81 | 66 | " |
| 508 | (37) | 83 | 82 | 65 | " |
| 509 | (39) | 80 | 78 | 67 | " |
| 510 | (26) | 82 | 80 | 66 | " |

It is seen from Table E that Samples 505 to 510 using the coupler of the present invention was superior to Sample 501 particularly in view of the heat fastness and to Samples 502 to 504 in view of the light fastness at the low density part and that they are apparently excellent in view of the total performance.

EXAMPLE 6

Samples 601 to 605 were prepared in the same manner as Sample 101 in Example 1 of JP-A-6-208196 except for replacing the following cyan coupler used in the second and third layers of Sample 101 by an equimolar amount of Coupler (13), (32), (37), (39) or (44) of the present invention.

A 2:1 (by weight) mixture of ExC-1 and ExC-2:

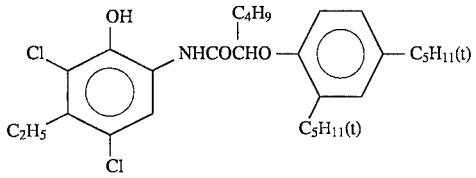

ExC-1

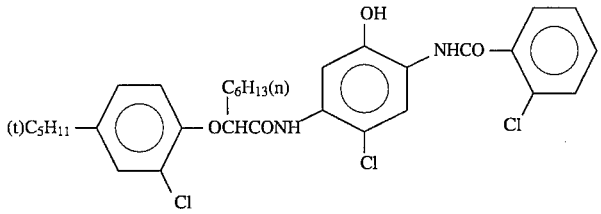

ExC-2

Each sample was exposed for sensitometry at 250 CMS for 1 second through an optical wedge using a sensitometer (Model FWH, color temperature of the light source: 3,200K, manufactured by Fuji Photo Film Co., Ltd.) and then processed as described in Example 1 of JP-A-6-208196.

Samples 606 to 610 were prepared in the same manner as Sample 101 in Example 1 of JP-A-6-118546 except for replacing the following cyan coupler used in the third layer of Sample 101 by an equimolar amount of Coupler (13), (32), (37), (39) or (44) of the present invention.

A 1:1 (by weight) mixture of ExC-1 and ExC-2:

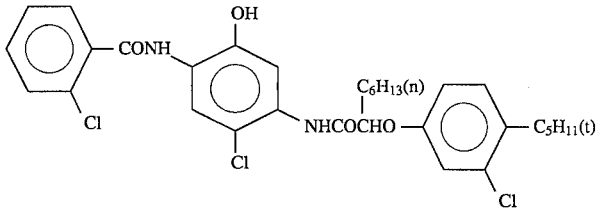

ExC-1

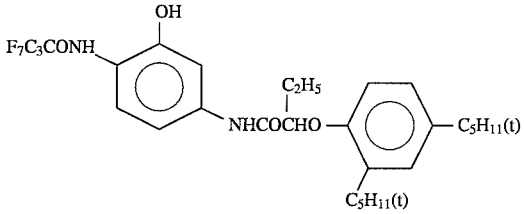

ExC-2

Each sample was exposed and developed according to the method described in Example 4 of JP-A-6-118546 to prepare a color proof.

The thus-obtained samples were evaluated thoroughly in the same manner as in Example 2 and then, it is seen that the photographic materials using the coupler of the present invention were excellent in view of the hue, the light fastness, the heat fastness and the processing dependency the same as shown in Example 2.

According to the present invention, a silver halide color photographic material excellent in the hue, the coupling activity, the heat fastness and the light fastness (in particular, at the toe part), undergoing less change in the color density due to the fluctuation in the composition of the processing solution and containing a cyan coupler, the coupler per se having excellent stability, can be provided.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one layer containing a coupler represented by formula (I)

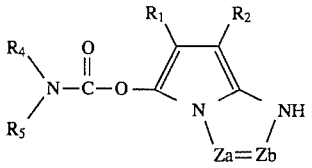

(I)

wherein Za represents —C($R_3$)= or —N=, provided that when Za represents —N=, Zb represents —C($R_3$)= and when Za represents —C($R_3$)=, Zb represents —N=; $R_1$ represents an electron withdrawing group having a Hammett's substituent constant, $\sigma_p$, of from 0.20 to 1.0; $R_2$ represents an electron withdrawing group having a Hammett's substituent constant, $\sigma_p$, of from 0.20 to 1.0 and is an aliphatic oxycarbonyl group, a cyano group, a carbamoyl group, a sulfamoyl group, a dialkylphosphono group or a diarylphosphono group; $R_3$ represents a substituent; $R_4$ and $R_5$ are the same or different, and each represents a hydrogen atom, an aliphatic group, an aryl group or a heterocyclic group; and $R_4$ and $R_5$ may combine with each other to form a 5-membered ring or a 6-membered ring and the 5-membered ring or the 6-membered ring may form a condensed ring with a benzene ring or a heterocyclic ring.

2. The silver halide photographic material as claimed in claim 1, wherein the sum of the $\sigma_p$ values of $R_1$ and $R_2$ is 0.70 or more and the upper limit thereof is about 1.8.

3. The silver halide photographic material as claimed in claim 1, wherein $R_1$ represents an acyl group, an acyloxy group, a carbamoyl group, an aliphatic oxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, an alkyl group substituted by at least two or more halogen atoms, an alkoxy group substituted by at least two or more halogen atoms, an aryloxy group substituted by at least two or more halogen atoms, an alkylamino group substituted by at least two or more halogen atoms, an alkylthio group substituted by at least two or more halogen atoms, an aryl group substituted by other electron withdrawing group having $\sigma_p$ of 0.20 or more, a heterocyclic group, a chlorine atom, a bromine atom, an azo group or a selenocyanate group.

4. The silver halide photographic material as claimed in claim 1, wherein $R_1$ represents a cyano group, an aliphatic oxycarbonyl group, a dialkylphosphono group, an alkylsulfonyl group, an arylsulfonyl group or a fluorinated alkyl group.

5. The silver halide photographic material as claimed in claim 1, wherein $R_1$ is a cyano group, an aliphatic oxycarbonyl group or a fluorinated alkyl group.

6. The silver halide photographic material as claimed in claim 1, wherein $R_1$ is a cyano group.

7. The silver halide photographic material as claimed in claim 1, wherein $R_2$ is an aliphatic oxycarbonyl group represented by formula (IV)

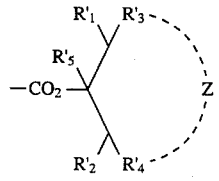

(IV)

wherein $R_1$' and $R_2$' each represents an aliphatic group, $R_3$', $R_4$' and $R_5$' each represents a hydrogen atom or an aliphatic group, and Z represents a nonmetallic atomic group necessary for forming a 5-, 6-, 7-, or 8-membered ring.

8. The silver halide photographic material as claimed in claim 7, wherein $R_3$', $R_4$' and $R_5$' each represents a hydrogen atom.

9. The silver halide photographic material as claimed in claim 7, wherein the ring formed by Z is a cyclopentane ring, a cyclohexane ring, a cycloheptane ring, a cyclooctane ring, a cyclohexene ring, a piperazine ring, an oxane ring or a thiane ring.

10. The silver halide photographic material as claimed in claim 7, wherein the ring formed by Z is a cyclohexane ring.

11. The silver halide photographic material as claimed in claim 10, wherein the ring formed by Z is a cyclohexane ring substituted at the 4-position by an alkyl group.

12. The silver halide photographic material as claimed in claim 1, wherein $R_3$ represents a halogen atom, an aliphatic group, an aryl group, a heterocyclic group, a cyano group, a hydroxyl group, a nitro group, a carboxy group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group or an azolyl group.

13. The silver halide photographic material as claimed in claim 1, wherein $R_3$ is an aliphatic group or an aryl group.

14. The silver halide photographic material as claimed in claim 1, wherein $R_3$ is a branched alkyl group or a cycloalkyl group.

15. The silver halide photographic material as claimed in claim 1, wherein $R_4$ and $R_5$ each represents a hydrogen atom; a linear or branched alkyl group having 1 to 36 carbon atoms; an aralkyl group having 1 to 36 carbon atoms; an alkenyl group having 1 to 36 carbon atoms; an alkynyl group having 1 to 36 carbon atoms; a cycloalkyl group having 1 to 36 carbon atoms; a cycloalkenyl group having 1 to 36 carbon atoms; an aryl group having from 6 to 36 carbon atoms; or a 5-, 6-, 7- or 8-membered ring (i) containing as a hetero atom a nitrogen atom, an oxygen atom or a sulfur atom and (ii) having 1 to 36 carbon atoms.

16. The silver halide photographic material as claimed in claim 1, wherein the coupler represented by formula (I) is used as a cyan coupler in a red-sensitive silver halide emulsion layer.

17. The silver halide photographic material as claimed in claim 1, wherein the coupler represented by formula (I) is used in amount of $1\times10^3$ mol to 1 mol, per mol of silver halide in the same layer.

18. A silver halide photographic material comprising a support having provided therein at least one layer containing a coupler represented by formula (V)

(V)

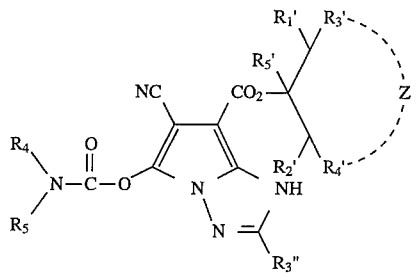

wherein

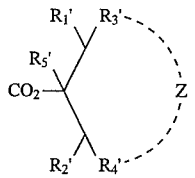

represents an electron withdrawing group having a Hammett's substituent constant, $\sigma_p$ of from 0.20 to 1.0; $R_4$ and $R_5$ are the same or different, and each represents a hydrogen atom, an aliphatic group, an aryl group or a heterocyclic group; $R_4$ and $R_5$ may combine with each other to form a 5-membered ring or a 6-membered ring and the 5-membered ring or the 6-membered ring may form a condensed ring with a benzene ring or a heterocyclic ring; $R_1'$ and $R_2'$ each represents an aliphatic group; $R_3'$, $R_4'$ and $R_5'$ each represents a hydrogen atom or an aliphatic group; and Z represents a nonmetallic atomic group necessary for forming a 5-, 6-, 7-, or 8-membered ring; and $R_3''$ represents an aliphatic group or an aryl group.

19. The silver halide photographic material as claimed in claim 18, wherein $R_3''$ represents a branched alkyl group or a cycloalkyl group; $R_3'$, $R_4'$ and $R_5'$ each represents a hydrogen atom; and the ring formed by Z represents a cyclohexane ring.

20. The silver halide photographic material as claimed in claim 18, wherein $R_3'$, $R_4'$ and $R_5'$ each represents a hydrogen atom.

21. The silver halide photographic material as claimed in claim 18, wherein the ring formed by Z is a cyclopentane ring, a cyclohexane ring, a cycloheptane ring, a cyclooctane ring, a cyclohexene ring, a piperazine ring, an oxane ring or a thiane ring.

22. The silver halide photographic material as claimed in claim 18, wherein the ring formed by Z is a cyclohexane ring.

23. The silver halide photographic material as claimed in claim 18, wherein the ring formed by Z is a cyclohexane ring substituted at the 4-position by an alkyl group.

24. The silver halide photographic material as claimed in claim 18, wherein $R_4$ and $R_5$ each represents a hydrogen atom; a linear or branched alkyl group having 1 to 36 carbon atoms; an aralkyl group having 1 to 36 carbon atoms; an alkenyl group having 1 to 36 carbon atoms; an alkynyl group having 1 to 36 carbon atoms; a cycloalkyl group having 1 to 36 carbon atoms; a cycloalkenyl group having 1 to 36 carbon atoms; an aryl group having from 6 to 36 carbon atoms; or a 5-, 6-, 7-, or 8-membered ring (i) containing as a hetero atom a nitrogen atom, an oxygen atom or a sulfur atom and (ii) having 1 to 36 carbon atoms.

25. The silver halide photographic material as claimed in claim 18, wherein the coupler represented by formula (V) is used as a cyan coupler in a red-sensitive silver halide emulsion layer.

26. The silver halide photographic material as claimed in claim 18, wherein the coupler represented by formula (V) is used in amount of $1\times10^{-3}$ mol to 1 mol, per mol of silver halide in the same layer.

* * * * *